US009986833B1

(12) United States Patent
Reid et al.

(10) Patent No.: US 9,986,833 B1
(45) Date of Patent: Jun. 5, 2018

(54) MODULAR CINEMA LOUNGE CHAIR

(71) Applicants: Charles S. Reid, Holland, MI (US); Bill Foley, Grandville, MI (US); George Kinsella, Holland, MI (US); Ron Lamer, Zeeland, MI (US); Ernest White, Allegan, MI (US); Ryan Volgelheim, Holland, MI (US)

(72) Inventors: Charles S. Reid, Holland, MI (US); Bill Foley, Grandville, MI (US); George Kinsella, Holland, MI (US); Ron Lamer, Zeeland, MI (US); Ernest White, Allegan, MI (US); Ryan Volgelheim, Holland, MI (US)

(73) Assignee: First Class Seating, LLC, Zeeland, MI (US)

( * ) Notice: Subject to any disclaimer, the term of this patent is extended or adjusted under 35 U.S.C. 154(b) by 0 days. days.

(21) Appl. No.: 14/676,949

(22) Filed: Apr. 2, 2015

Related U.S. Application Data

(63) Continuation-in-part of application No. 14/665,729, filed on Mar. 23, 2015.

(60) Provisional application No. 61/974,092, filed on Apr. 2, 2014, provisional application No. 61/969,202, filed on Mar. 23, 2014.

(51) Int. Cl.

| | |
|---|---|
| ***A47C 1/12*** | (2006.01) |
| ***A47C 7/62*** | (2006.01) |
| ***A47C 1/024*** | (2006.01) |
| ***A47C 7/50*** | (2006.01) |
| ***A47C 7/54*** | (2006.01) |

(52) U.S. Cl.
CPC ..... *A47C 1/12* (2013.01); *A47C 1/024* (2013.01); *A47C 1/0242* (2013.01); *A47C 7/506* (2013.01); *A47C 7/54* (2013.01); *A47C 7/62* (2013.01)

(58) Field of Classification Search
CPC ..... A47C 7/34; A47C 7/028; A47C 1/024; A47C 1/0242; A47C 7/506; A47C 7/54; A47C 7/62
See application file for complete search history.

(56) References Cited

U.S. PATENT DOCUMENTS

| | | | |
|---|---|---|---|
| 2,257,496 | A | 9/1941 | Gaugler et al. |
| 2,492,119 | A | 12/1949 | Roman |
| 2,828,803 | A | 4/1958 | Howe et al. |
| 3,297,359 | A | 1/1967 | Douglas |

(Continued)

FOREIGN PATENT DOCUMENTS

| | | |
|---|---|---|
| EP | 1 415 574 | 6/2007 |

*Primary Examiner* — Charles A Fox
*Assistant Examiner* — Christopher E Veraa
(74) *Attorney, Agent, or Firm* — King & Partners, PLC

(57) ABSTRACT

A modular cinema lounge chair including a seat member, a back and headrest support member that is adapted to be rockably and/or controllably and lockably displaceable between an upright/retracted position and a reclined/extended position, a left arm, a right arm, a floor-engaging frame sub-assembly, a left side, a right side, a front side or optional leg rest that is controllably and lockably displaceable between a lowered/retracted position and a raised/extended position via a hydraulic cylinder or electric motor, and a back side, wherein the frame sub-assembly includes a clean, simplified, and extremely sturdy structure which is adapted to accommodate the wear and tear associated with high volume use in today's cinemas, theaters, and auditoriums.

8 Claims, 31 Drawing Sheets

(56) References Cited

U.S. PATENT DOCUMENTS

| | | | | |
|---|---|---|---|---|
| 3,865,430 | A | 2/1975 | Tanus | |
| 3,905,051 | A * | 9/1975 | Gozdziewski | A47C 15/004 297/188.14 |
| 5,104,190 | A * | 4/1992 | Siegrist | B60N 2/22 297/354.1 |
| 5,678,889 | A | 10/1997 | Purcell, Jr. | |
| 6,170,898 | B1 * | 1/2001 | Cunningham, II | B60N 2/0232 296/65.13 |
| 6,582,020 | B1 | 6/2003 | Tenenboym et al. | |
| 6,652,030 | B2 | 11/2003 | Conner et al. | |
| 6,942,295 | B1 * | 9/2005 | Lopez | A47C 1/024 267/141.1 |
| 6,974,186 | B1 * | 12/2005 | Chang | A47C 1/035 297/423.19 |
| 7,600,817 | B2 * | 10/2009 | Kramer | A47C 1/022 297/354.13 |
| 7,934,773 | B2 | 5/2011 | Boulais et al. | |
| 2010/0244534 | A1 * | 9/2010 | Driessen | B60N 2/4495 297/423.35 |
| 2011/0043006 | A1 * | 2/2011 | Butt | A47C 7/38 297/68 |

* cited by examiner

MODULAR CINEMA LOUNGE CHAIR

CROSS-REFERENCE TO RELATED APPLICATIONS

This application is a continuation-in-part of U.S. application Ser. No. 14/665,729, filed Mar. 23, 2015, entitled "Cinema Lounge Chair," which claims the benefit of U.S. Provisional Application Ser. No. 61/969,202, filed Mar. 23, 2014, entitled "Cinema Lounge Chair Assembly" and U.S. Provisional Application Ser. No. 61/974,092, filed Apr. 2, 2014, entitled "Cinema Lounge Chair Assembly," all of which are hereby incorporated herein by reference in their entirety—including all references and appendices cited therein.

BACKGROUND OF THE INVENTION

1. Field of the Invention

The present invention relates in general to cinema or theater lounge chairs and, more particularly, to a plurality of novel cinema or theater lounge chairs that are configured to provide a theater patron with a luxurious experience not seen heretofore. The present invention further relates to cinema or theater lounge chairs that are modular and utilize replaceable components and sub-assemblies, which, in turn, facilitate efficient manufacturing and installation practices, as well as labor-saving onsite repairs. The present invention yet further relates to a frame sub-assembly that delivers a clean, simplified, and extremely sturdy structure necessary for the wear and tear associated with high volume use in today's cinemas, theaters, and auditoriums.

2. Background Art

Cinema and theater chairs have been known in the art for years and are the subject of a plurality of patents and/or publications, including: U.S. Pat. No. 7,934,773 entitled "Motion-Enabled Movie Theater Seat," U.S. Pat. No. 6,652,030 entitled "Chair Seat," U.S. Pat. No. 6,582,020 entitled "Theater Seat Assembly," U.S. Pat. No. 5,678,889 entitled "Moveable Theater Seats," U.S. Pat. No. 3,865,430 entitled "Theater Chair Automatically Movable By Remote Control," U.S. Pat. No. 3,297,359 entitled "Theatre Seat With Folding Arm Tablet," U.S. Pat. No. 2,828,803 entitled "Theater Chair With Self-Folding Seat," U.S. Pat. No. 2,492,119 entitled "Retracting Type Theater Chair," U.S. Pat. No. 2,257,496 entitled "Chair For Motion Picture Theaters," and European Patent Number 1,415,574 B1 entitled "Method Of Producing Variably-Configured Frames for Cinema Seats And/Or Similar Elements And The Frame Thus Obtained,"—all of which are hereby incorporated herein by reference in their entirety including all references cited therein.

U.S. Pat. No. 7,934,773 appears to disclose an actuated chair for inducing motion with respect to the ground as a function of motion signals synchronized with a video output of a feature length movie. The chair comprises a seat base, and an actuating base for receiving the motion signals. The actuating base comprises three link members, namely a first link member, a second link member and a third link member. Each link member has one translational degree of freedom and two rotational degrees of freedom. The first link member and the second link member are attached to the seat base closer to the rear edge than the third link member. The actuating base further comprises three linear actuators for inducing motion to the seat base. The actuators are fixed to the frame and each actuator is respectively connected to the seat base using a respective one of the three link members.

U.S. Pat. No. 6,652,030 appears to disclose a chair seat that is movable between an upright and a forward position that includes a spring mechanism which biases the seat toward the upright position. The spring mechanism includes cam structures that utilize both compressional and torsional forces from the spring to bias the seat toward the upright position. The compression of the spring exerts a positive force that must be overcome before the seat can be moved out of its upright position. The chair seat is constructed from a number of discrete components that are secured together without the use of welding or separate fasteners, such as via snap-fits. The discrete components include positioning tabs, special shapes, and other features that prevent them from being improperly assembled. The components of the chair seat may all be constructed out of suitable durable plastics, such as polypropylene, polyethylene, polycarbonate, and glass filled thermoplastics.

U.S. Pat. No. 6,582,020 appears to disclose a theater seat assembly that includes a pair of opposed stanchions for attachment to a support surface, a generally horizontal seat portion disposed between and operatively connected to the stanchions, and a generally upright back portion disposed between and operatively connected to the stanchions. The theater seat assembly includes a counter-balanced pivot mechanism operatively connected to the seat portion and the stanchions to allow the seat portion to pivot freely relative to the stanchions when unoccupied relative to the stanchion. The theater seat assembly also includes a molded cover attached to at least one of the seat frame and the back frame and is injection molded from a fiberglass reinforced copolymer.

U.S. Pat. No. 5,678,889 appears to disclose a modular assembly of theater seats aligned in a row. Each of the seats in the row moves with an identical motion in response to a coordinated sequence to create seat motions which can complement a scene being portrayed on a movie screen. Three or more rotatable shafts run along the row under the seats. The shafts are caused to rotate by hydraulic cylinders coupled to the shafts through bell cranks. Each seat is supported by three legs which are also coupled to the shafts by bell cranks. Rotation of the shafts causes vertical motion of the legs, and by coordinating the motions of the individual legs, in one embodiment of the invention, the seats can be made to move with linear vertical motion, or to rotate either side to side or fore and aft in the vertical plane. Linear fore and aft motion of the seats may be provided by a fourth rotatable shaft running along the row under the seats.

U.S. Pat. No. 3,865,430 appears to disclose a theater chair movable by remote control that comprises a support structure, a chassis having a back and arms installed on same, and a seat rotatably engaged to the chassis. The support structure comprises at each side of the chassis, a vertical sliding mechanism and a horizontal sliding mechanism. The sliding mechanisms comprise rotatable threaded spindles and sleeves threadedly engaged thereon. The horizontal sliding mechanisms are attached by universal joints to the chassis of the chair and both vertical and horizontal sliding mechanisms are driven by independent drive motors, operated by remote control by sending a signal in synchronism with a scene of the show. The seat contains a vibrator for producing vibrational and rhythmic movements in the seat.

U.S. Pat. No. 3,297,359 appears to disclose in combination with a seat supported between at least one pair of vertical members, a collapsible tablet assembly associated with an arm rest secured to one of said vertical members, said tablet assembly comprising a member pivotally secured to said arm rest so as to form in one position an extension of said arm rest, a shaft extending longitudinally of said pivotal member and configured for axial rotation thereon, a tablet secured to said shaft, and means on the inner end of said shaft cooperating with said arm rest for locking said pivotal member in said one position to prevent downward movement thereof when said tablet is in use.

U.S. Pat. No. 2,828,803 appears to disclose a seat mounting hinge whereby chair seats of the plywood type mounted on exposed hinges may be made self-folding to raised non-use positions, thus to provide maximum space between rows of seats for the ingress and egress of patrons. The seat mounting hinge in which the self-folding mechanism is enclosed so that it cannot injure the chair occupants or damage their wearing apparel. This patent further appears to disclose a self-folding mechanism which is adjustable so that the force with which the seat is automatically raised to non-use position can be adjusted, and in general to provide such a mechanism which is quiet in operation, efficient in use, and reasonably economical to manufacture.

U.S. Pat. No. 2,492,119 appears to disclose a theater chair of the retracting type wherein the chair occupant may move rearwardly in a sitting position in order to permit other theater patrons to pass in front of him/her.

U.S. Pat. No. 2,257,496 appears to disclose a chair for motion picture theaters and more particularly to a seat having an illuminated signal which is lit when the seat is unoccupied so as to facilitate the seating of patrons in the dark theater.

European Patent Number 1,415,574 appears to disclose a process for obtaining frames for cinema and theatre chairs and/or the like based on a small number of molded plastic parts allowing to produce chairs with a varying appearance and with support legs adapted to the height required for the chair as well as to the inclined plane of the floor on which they will be installed.

While the above-identified patents and/or publications do appear to disclose various cinema or theater chairs, their configurations remain non-desirous and/or problematic inasmuch as, among other things, none of the above-identified cinema chairs appear to be configured to provide a theater patron with a truly luxurious experience. Furthermore, none of the above-identified cinema chairs appear to be modular and utilize a frame sub-assembly that delivers a clean, simplified, and extremely sturdy structure, as is provided herein, which is adapted to accommodate the wear and tear associated with high volume use in today's cinemas, theaters, and auditoriums.

It is therefore an object of the present invention to provide truly luxurious cinema lounge chairs and associated frame sub-assemblies as are disclosed herein.

These and other objects of the present invention will become apparent in light of the present specification, claims, and appended drawings.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

SUMMARY OF THE INVENTION

Figure 1:
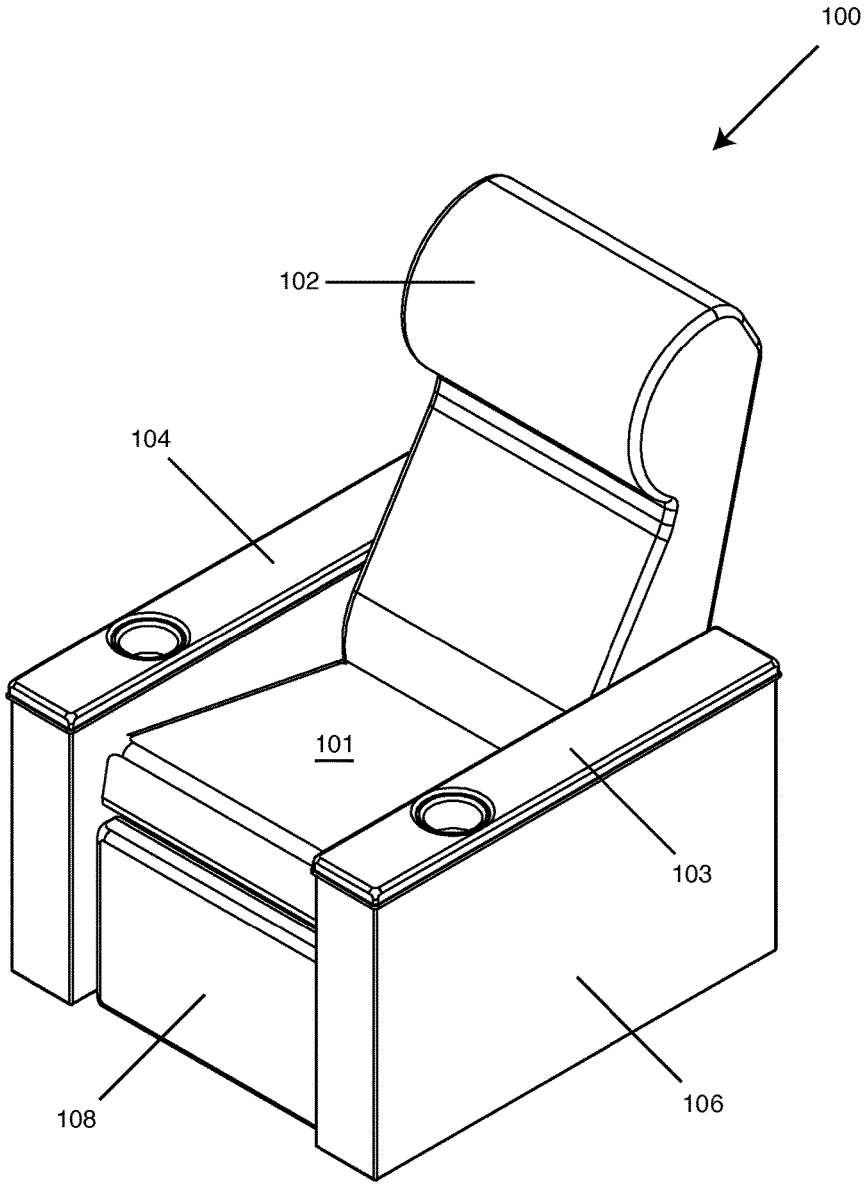
FIG. 1 of the drawings is a front perspective view of a cinema lounge chair fabricated in accordance with the present invention.
Figure 2:
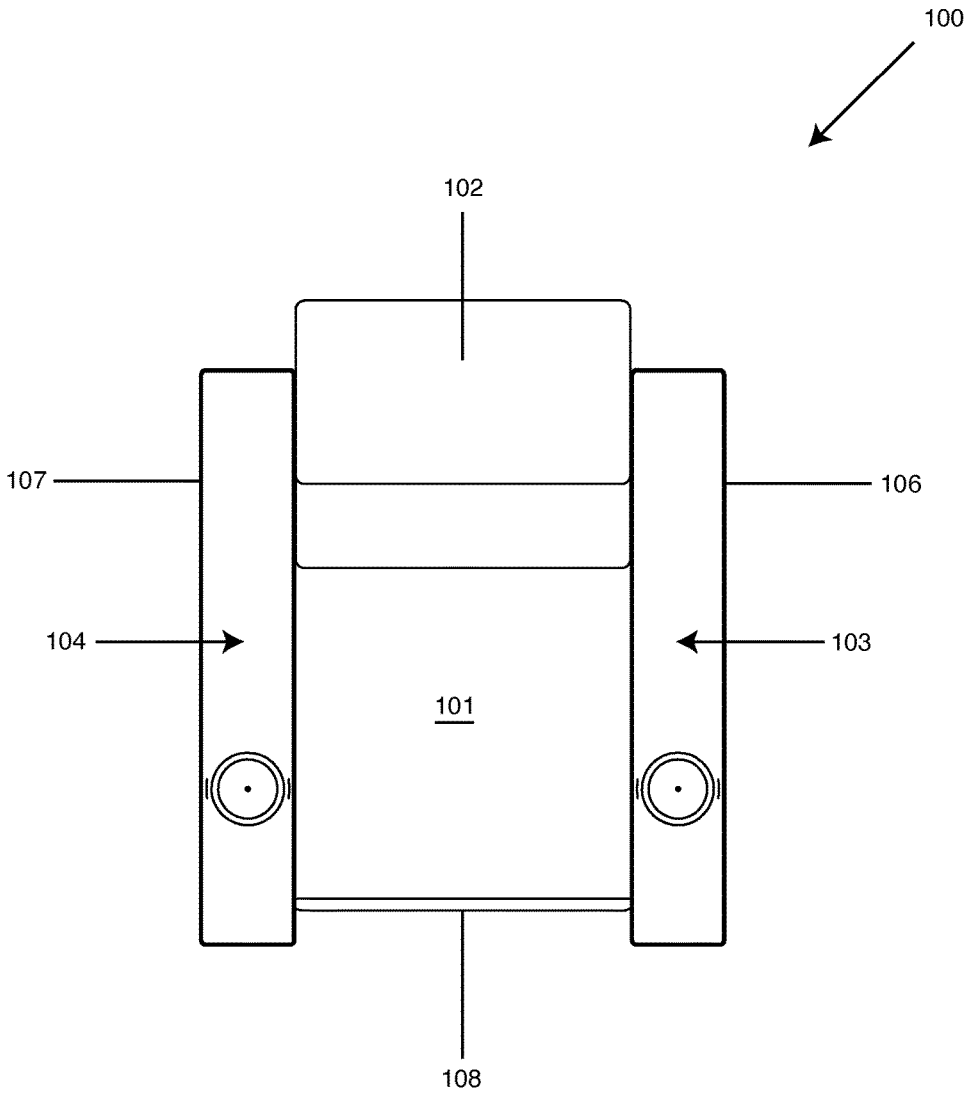
FIG. 2 of the drawings is a top plan view of a cinema lounge chair fabricated in accordance with the present invention.
Figure 3:
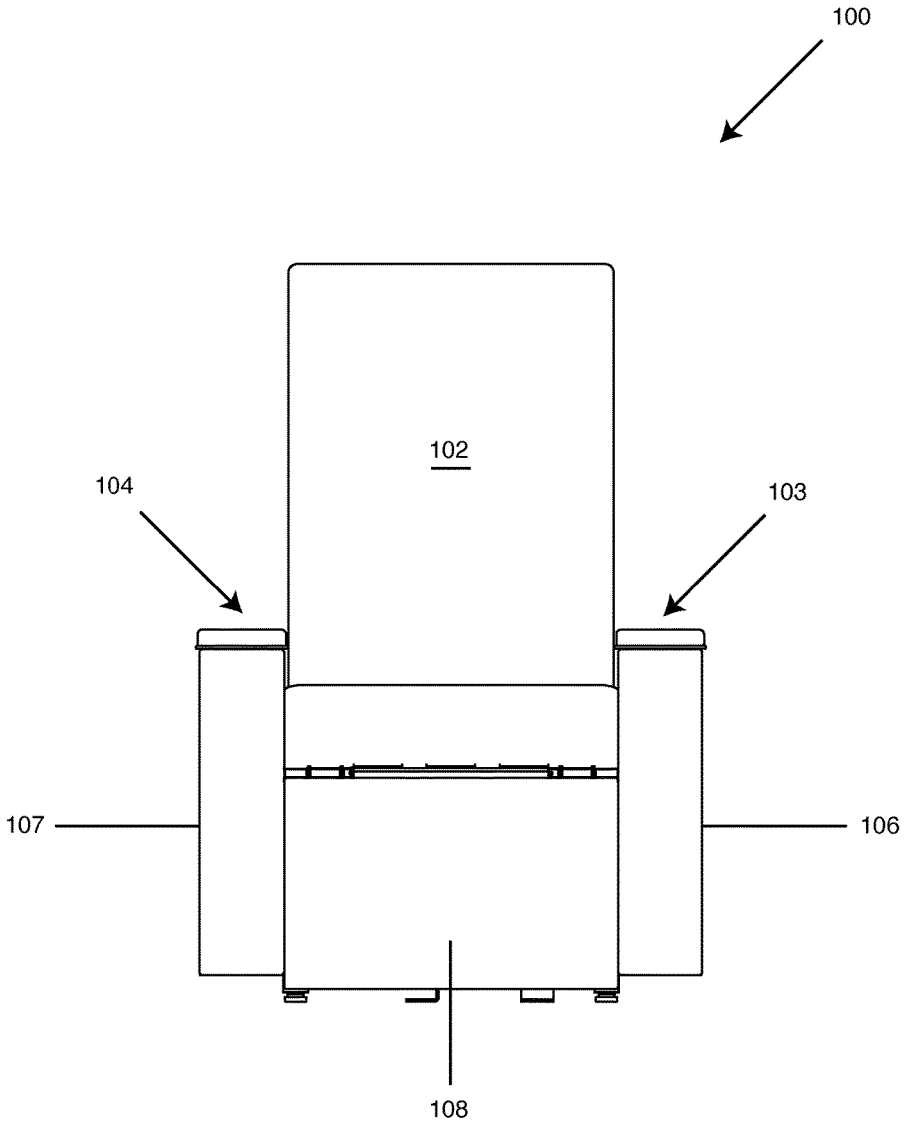
FIG. 3 of the drawings is a front end view of a cinema lounge chair fabricated in accordance with the present invention.
Figure 4:
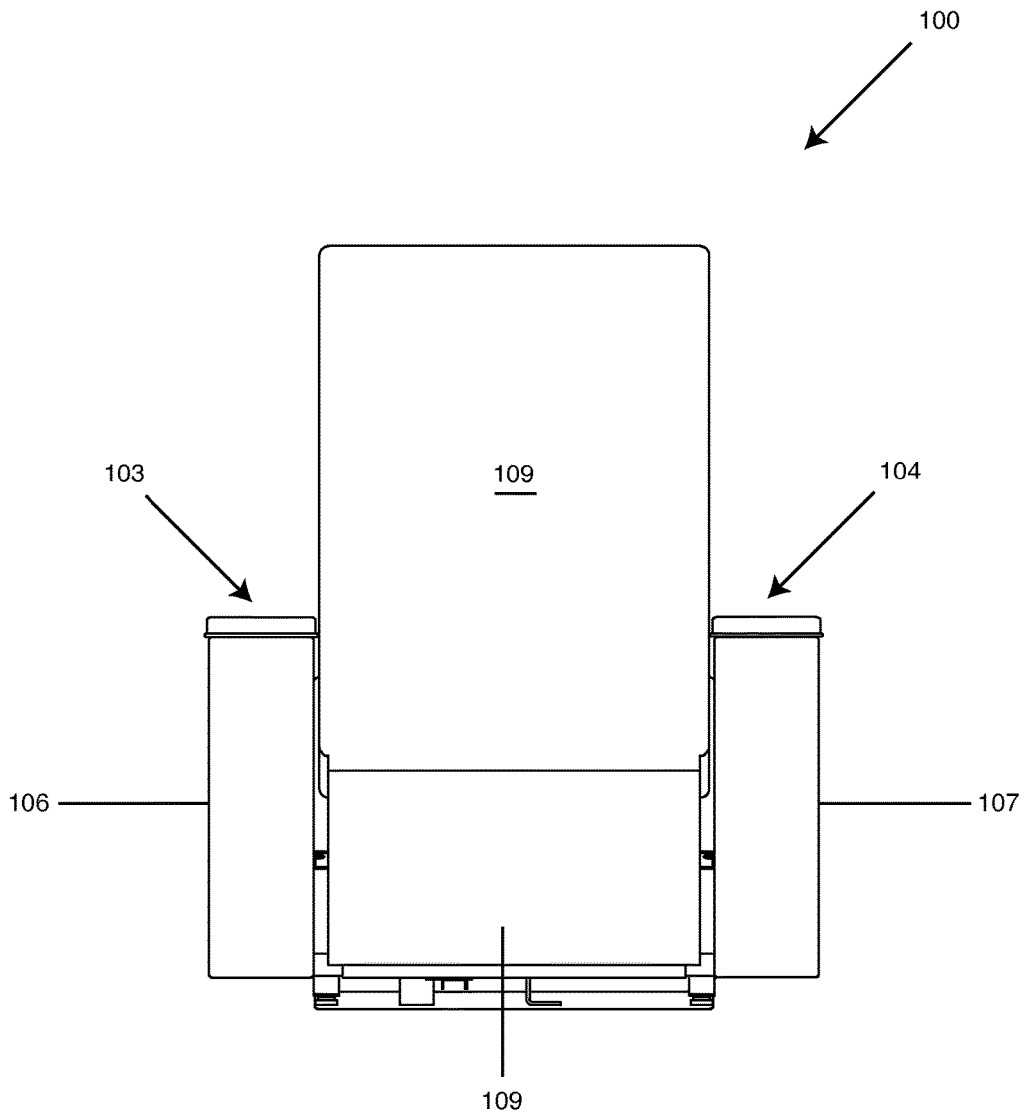
FIG. 4 of the drawings is a rear end view of a cinema lounge chair fabricated in accordance with the present invention.

The present invention is directed to, in one embodiment, a modular cinema lounge chair comprising, consisting essentially of, and/or consisting of: (a) a seat member; (b) a back and headrest support member, wherein the back and headrest support member is rockably displaceable between an upright position and a reclined position; (c) a left arm; (d) a right arm; (e) a left side; (f) a right side; (g) a front side/leg rest; (h) a back side; and (i) a floor-engaging frame sub-assembly, wherein the frame sub-assembly comprises a clean, simplified, and extremely sturdy structure which is adapted to accommodate the wear and tear associated with high volume use in today's cinemas, theaters, and auditoriums. In this embodiment, the modular cinema lounge chair optionally comprises a leg rest that is controllably and lockably displaceable between a lowered/retracted position and a raised/extended position via an electric motor.

The present invention is also directed to, in one embodiment, a modular cinema lounge chair comprising, consisting essentially of, and/or consisting of: (a) a seat member; (b) a back and headrest support member, wherein the back and headrest support member is controllably and lockably displaceable between an upright/retracted position and a reclined/extended position; (c) a left arm; (d) a right arm; (e) a left side; (f) a right side; (g) a front side/leg rest; (h) a back side; and (i) a floor-engaging frame sub-assembly, wherein the frame sub-assembly comprises a clean, simplified, and extremely sturdy structure which is adapted to accommodate the wear and tear associated with high volume use in today's cinemas, theaters, and auditoriums. In this embodiment the modular cinema lounge chair optionally comprises a leg rest that is controllably and lockably displaceable between a lowered/retracted position and a raised/extended position via a hydraulic cylinder and/or electric motor.

In a preferred embodiment of the present invention, the modular cinema lounge chair comprises a frame sub-assembly having one or more compression-friction fit joints.

In another preferred embodiment of the present invention, the modular cinema lounge chair comprises a frame sub-assembly that includes a lower left support member having a front end and a rear end, a lower right support member having a front end and a rear end, an upper left support member having a front end and a rear end, an upper right support member having a front end and a rear end, a lower front support member having a left end and a right end, an upper front support member having a left end and a right end, a lower rear support member having a left end and a right end, an upper rear support member having a left end and a right end, a substantially vertical front left support member having an upper end and a lower end, a substantially vertical front right support member having an upper end and a lower end, a substantially vertical rear left support member having an upper end and a lower end, and a substantially vertical rear right support member having an upper end and a lower end.

DETAILED DESCRIPTION OF THE INVENTION

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

It will be further understood that FIGS. 1-13D are merely representations and/or illustrations of cinema lounge chairs and their associated sub-assemblies. As such, some of the components may be distorted from their actual scale for pictorial clarity and/or image enhancement.

Unless otherwise specified, the modular cinema lounge chairs, sub-assemblies, components and/or parts provided herein below are commercially available from Charter House Innovations (CHi) (Zeeland, Mich.) or a subsidiary thereof.

The modular cinema lounge chairs of the present invention comprise a plurality of configurations, all of which provide a theater patron with a truly luxurious experience not seen heretofore. Additionally, each one of the modular cinema lounge chairs of the present invention comprise a frame sub-assembly that delivers a clean, simplified, and extremely sturdy structure which is adapted to accommodate the wear and tear associated with high volume use in today's cinemas, theaters, and auditoriums.

Figure 5:
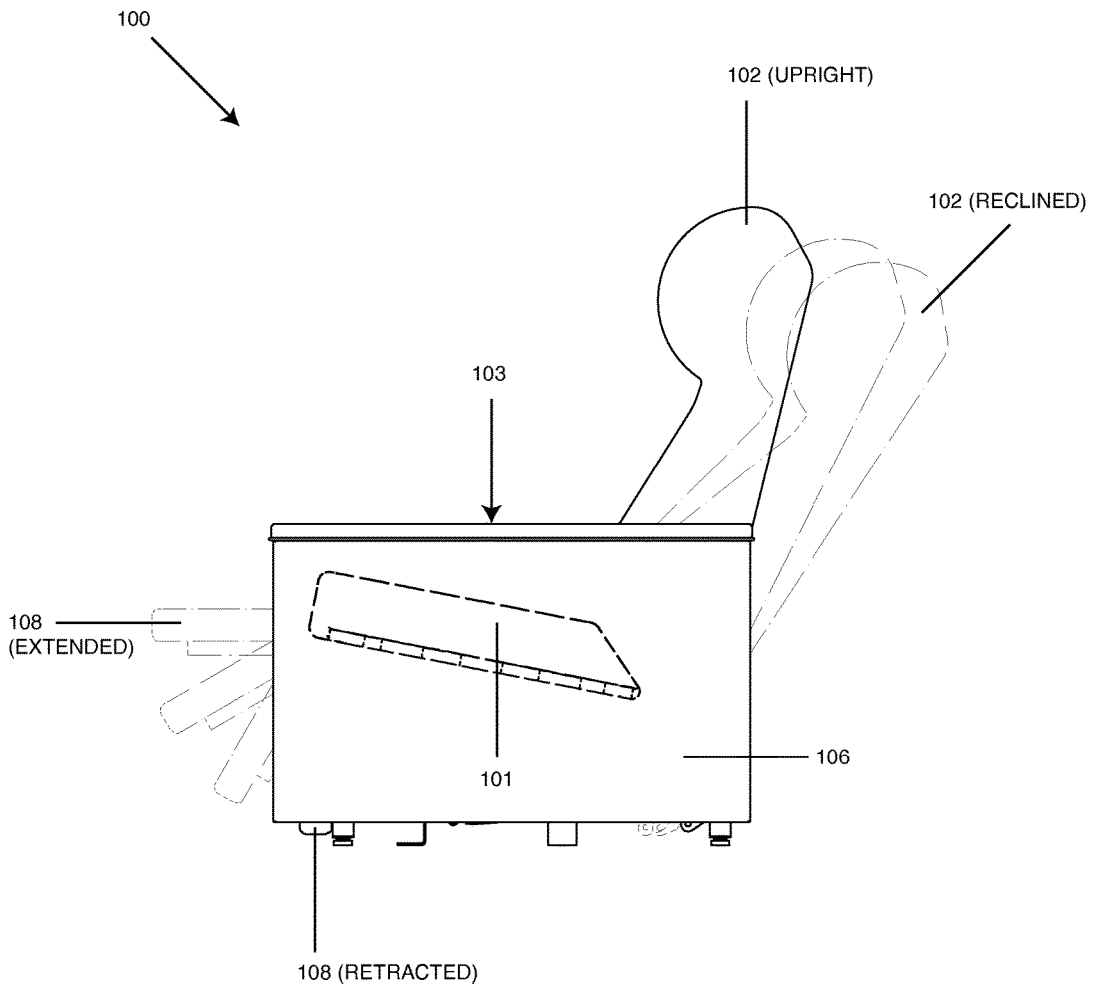
FIG. 5 of the drawings is a left side view of a cinema lounge chair fabricated in accordance with the present invention—it will be understood that a right side view is generally a mirror image of the left side view.
Figure 6:
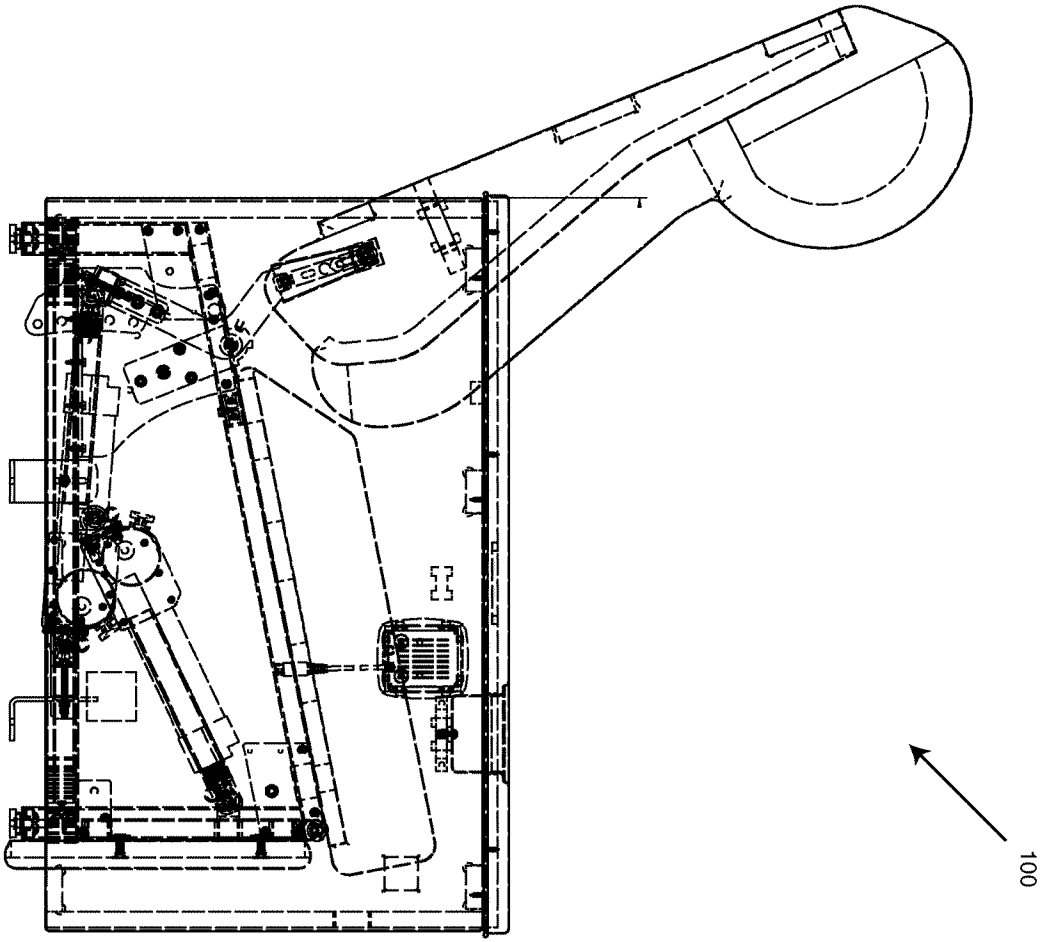
FIG. 6 of the drawings is a right side view of an embodiment of a cinema lounge chair fabricated in accordance with the present invention, showing among other things, a plurality of components and sub-assemblies.
Figure 7:
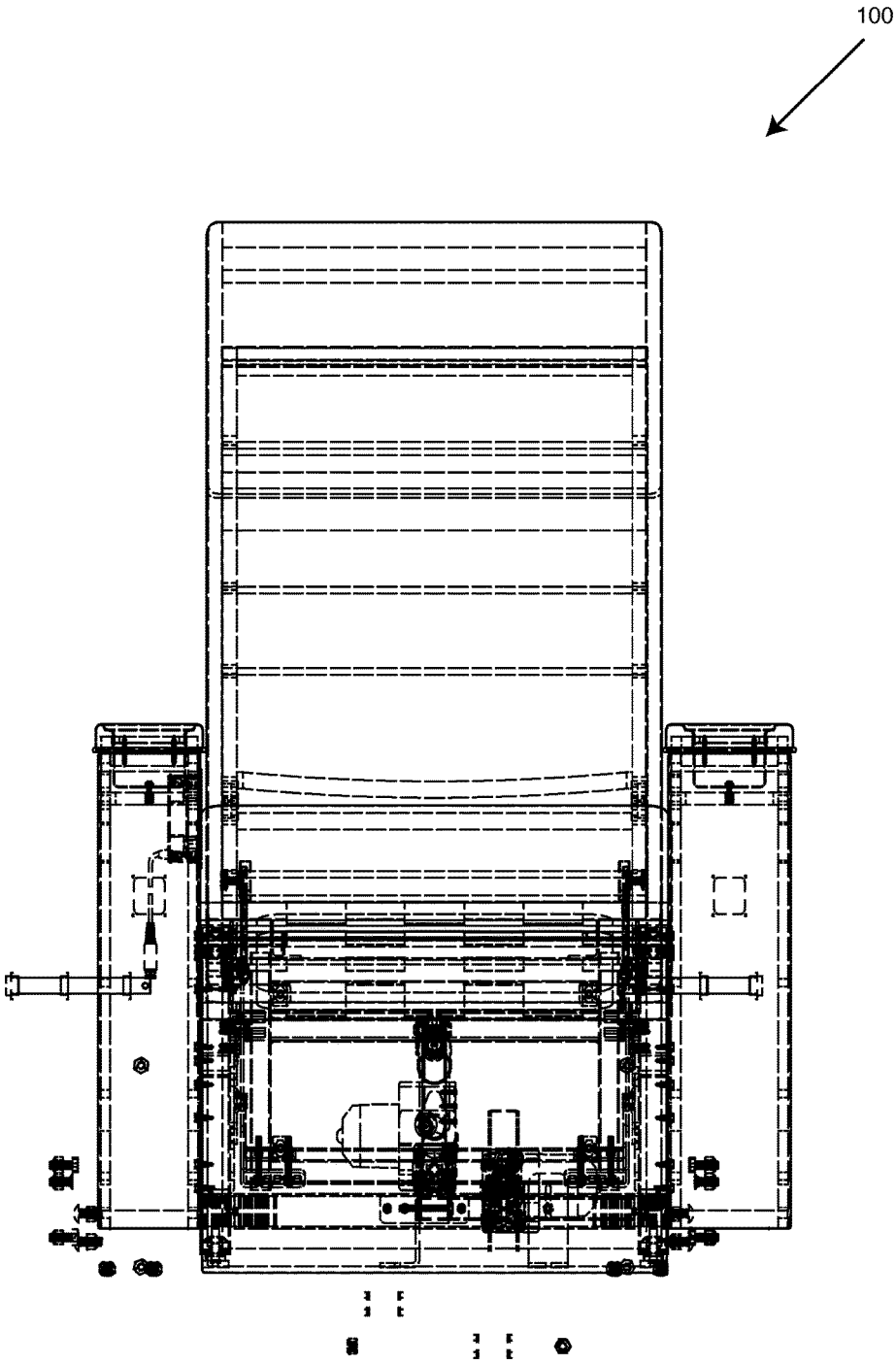
FIG. 7 of the drawings is a rear end view of an embodiment of a cinema lounge chair fabricated in accordance with the present invention, showing among other things, a plurality of components and sub-assemblies.

Referring now to the drawings, and to FIGS. 1-5 in particular, cinema lounge chair 100 is disclosed as generally comprising seat member 101, back and headrest support member 102, left arm 103, right arm 104, floor-engaging frame sub-assembly 105 (See FIGS. 8A-13D), left side 106, right side 107, front side/leg rest 108, and back side 109. In accordance with the present invention, back and headrest support member 102 is either rockably displaceable between an upright position and a reclined position via, for example one or more rubber grommets, or controllably (e.g., at generally infinite intervals) and lockably displaceable between an upright/retracted position and a reclined/extended position via, for example, a hydraulic cylinder or electric motor (FIG. 5). In further accordance with the present invention, leg rest 108 is either fixed in position and serves as a front side, or controllably (e.g., at generally infinite intervals) and lockably displaceable between a lowered/retracted position and a raised/extended position via a hydraulic cylinder or electric motor (FIG. 5).

In accordance with the present invention and as will be disclosed in greater detail herein below, seat member 101, back and headrest support member 102, left arm 103, and right arm 104, front side/leg rest 108, preferably comprise modular sub-assemblies that generally include a substrate (e.g., a wood, metal and/or plastic frame or body) optionally associated with cushioning (e.g., natural and/or synthetic cushions, foams, polyurethane, polystyrene, expanded polypropylene, etcetera) that is covered with, for example, upholstery, vinyl, leather, etcetera. Seat member 101 is preferably releasably secured to frame sub-assembly 105 via hook and loop fasteners positioned on the bottom side of seat member 101 and the top surfaces of the upper left and right support members of frame sub-assembly 105. Seat member 101 may also be secured to frame sub-assembly 105 via bolts, rivets threaded and non-threaded fasteners, and adhesives—just to name a few. Back and headrest support member 102, left arm 103, right arm 104, and front side/leg rest 108 are preferably secured to brackets associated with frame sub-assembly 105 via threaded fasteners. However, these modular components may also be secured to frame sub-assembly 105 via bolts, rivets non-threaded fasteners, and adhesives—just to name a few.

Referring now to FIGS. 1-5 and 8A-D, a first embodiment of cinema lounge chair 100 is shown which generally comprises seat member 101, back and headrest support member 102, left arm 103, right arm 104, floor-engaging frame sub-assembly 105 (See FIGS. 8A-8D), left side 106, right side 107, front side 108, and back side 109. In this embodiment back and headrest support member 102 of cinema lounge chair 100 includes a gentle rocking movement that is manually actuated by the theater patron or occupant.

In this embodiment of the present invention, and as is shown in FIGS. 8A-8D, cinema lounge chair 100 includes floor-engaging frame sub-assembly 105 which comprises lower left support member 2 having a front end and a rear end, lower right support member 4 having a front end and a rear end, upper left support member 6 having a front end and a rear end, upper right support member 8 having a front end and a rear end, lower front support member 10 having a left end and a right end, upper front support member 12 having a left end and a right end, lower rear support member 14 having a left end and a right end, upper rear support member 16 having a left end and a right end, substantially vertical front left support member 18 having an upper end and a lower end, substantially vertical front right support member 20 having an upper end and a lower end, substantially vertical rear left support member 22 having an upper end and a lower end, and substantially vertical rear right support member 24 having an upper end and a lower end.

Figure 8A:
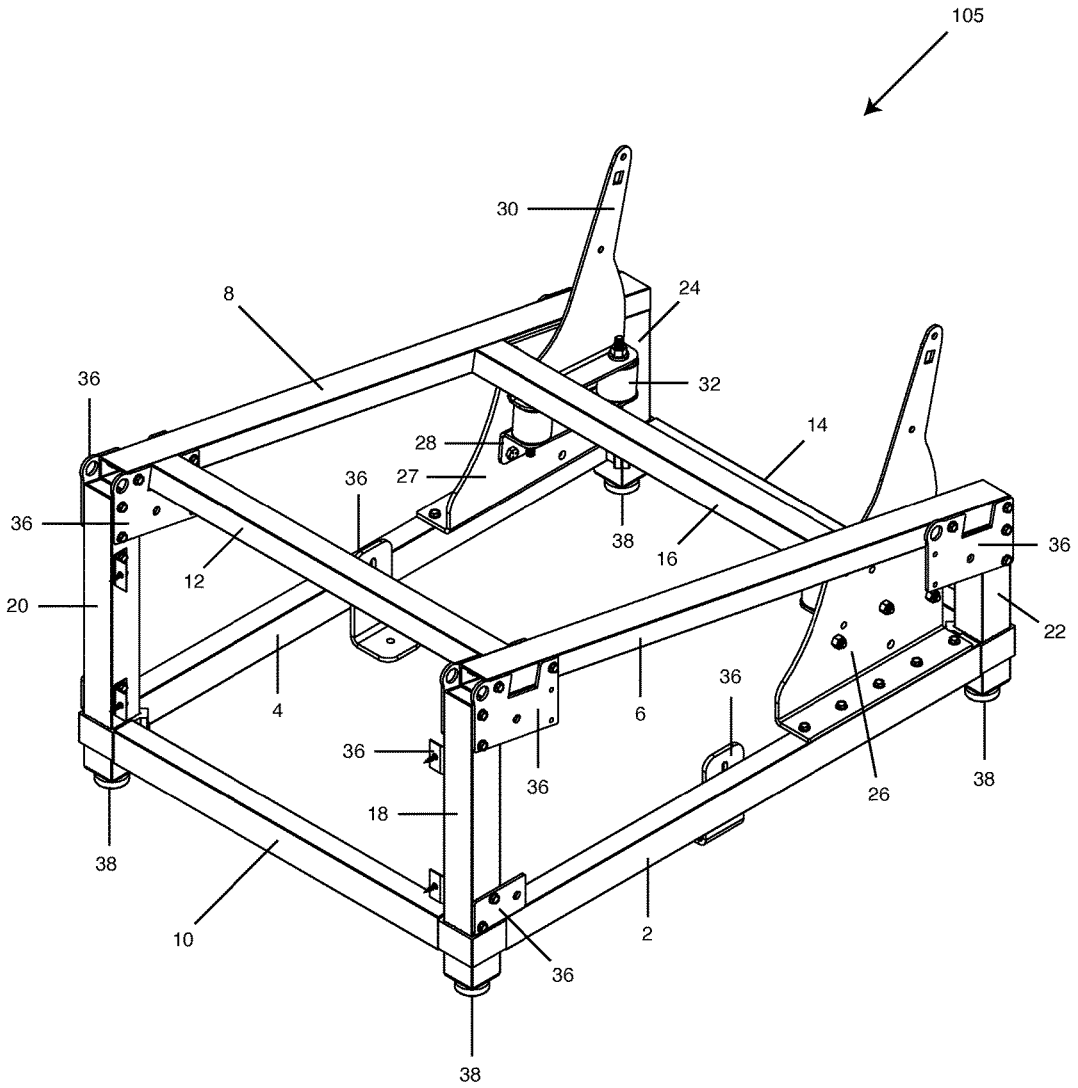
FIG. 8A of the drawings is an isometric view of a first embodiment of a frame sub-assembly fabricated in accordance with the present invention.
Figure 8B:
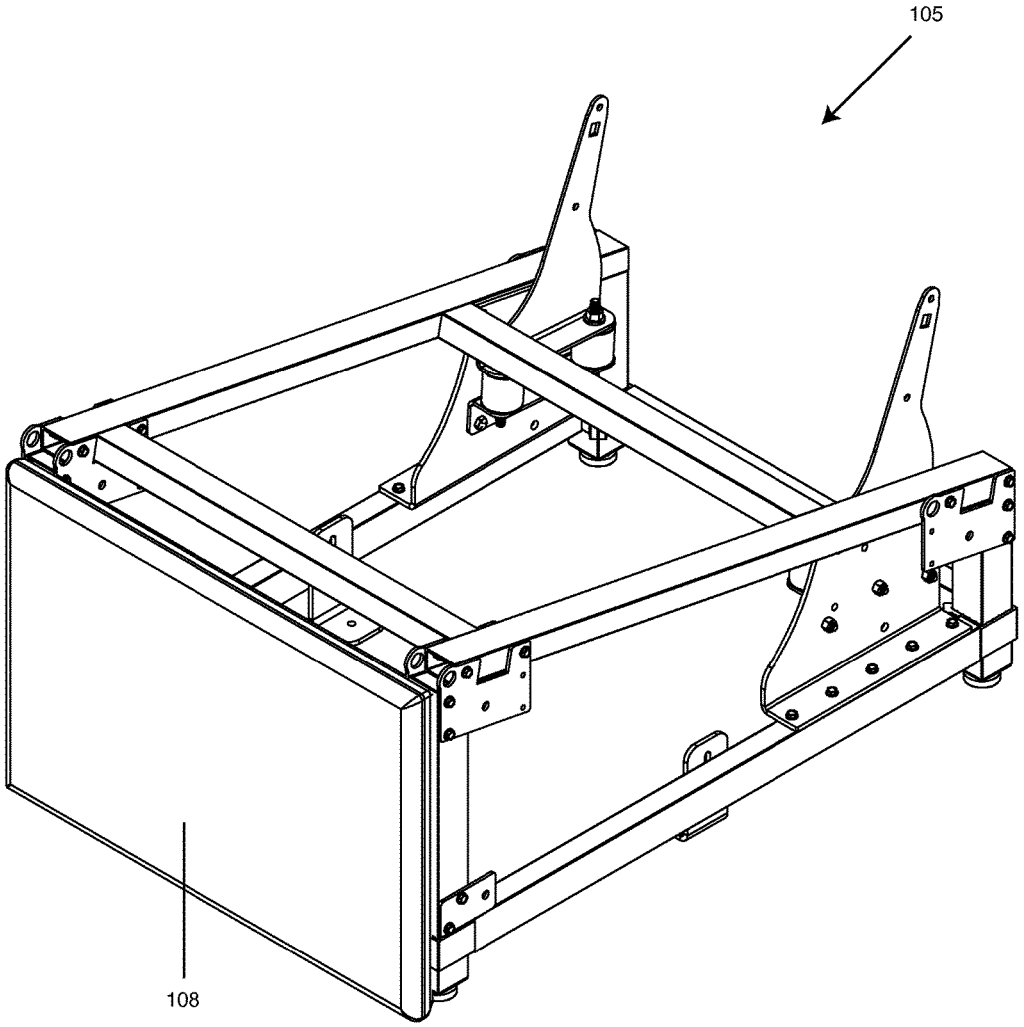
FIG. 8B of the drawings is an isometric view of a first embodiment of a frame sub-assembly fabricated in accordance with the present invention showing a front member secured thereto.
Figure 8C:
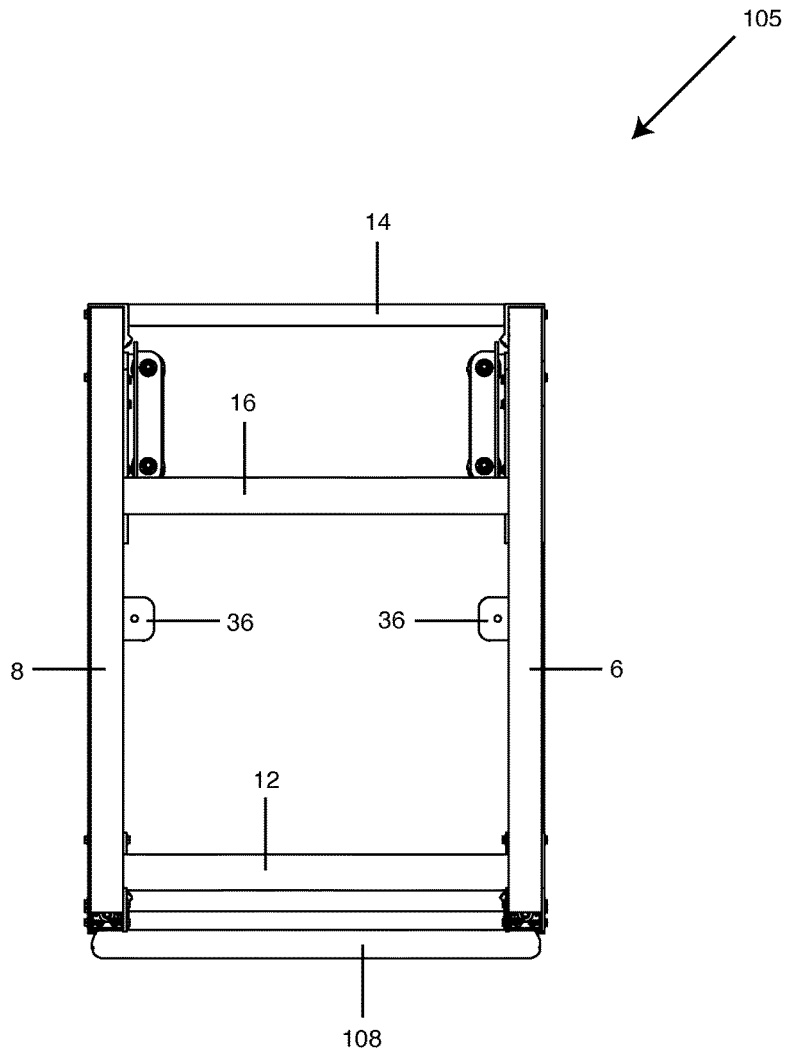
FIG. 8C of the drawings is a top plan view of a first embodiment of a frame sub-assembly fabricated in accordance with the present invention.
Figure 8D:
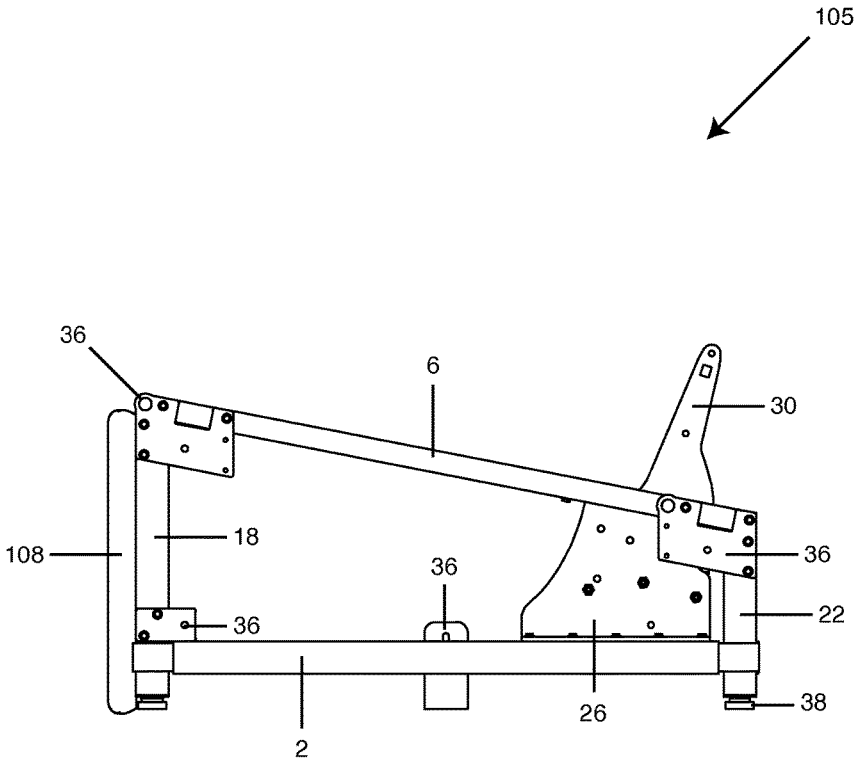
FIG. 8D of the drawings is a side view of a first embodiment of a frame sub-assembly fabricated in accordance with the present invention.
Figure 9A:
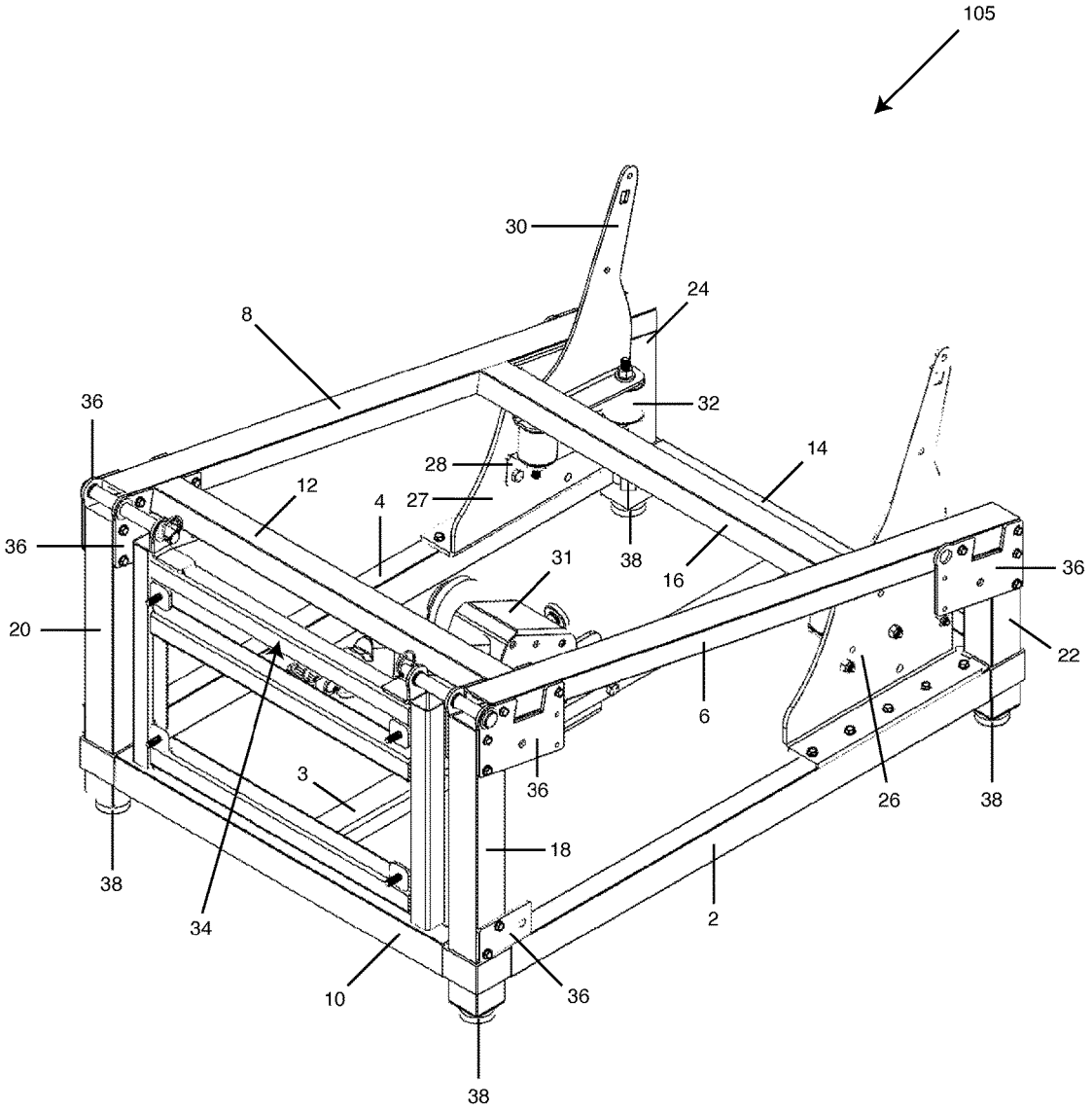
FIG. 9A of the drawings is an isometric view of a second embodiment of a frame sub-assembly fabricated in accordance with the present invention.
Figure 9B:
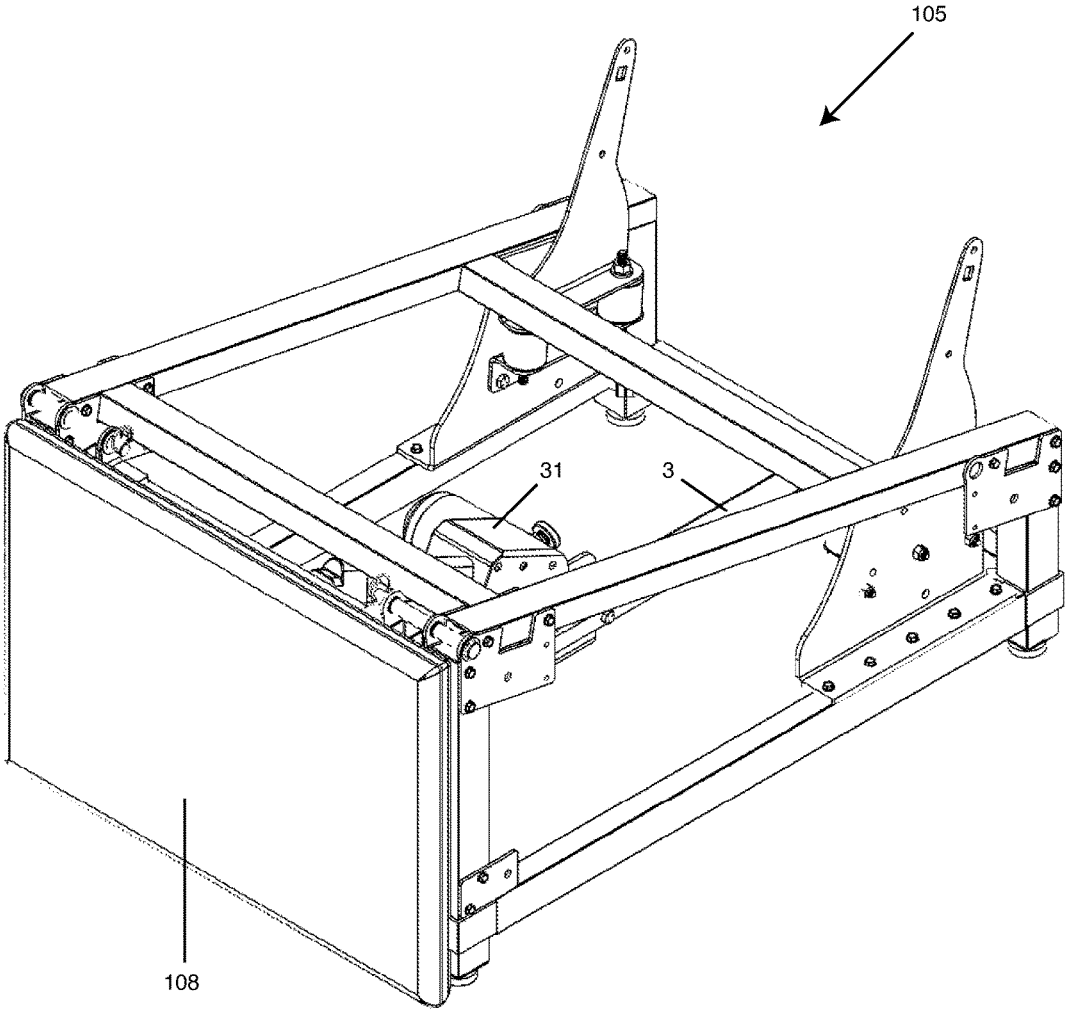
FIG. 9B of the drawings is an isometric view of a second embodiment of a frame sub-assembly fabricated in accordance with the present invention showing a leg rest associated therewith.
Figure 9C:
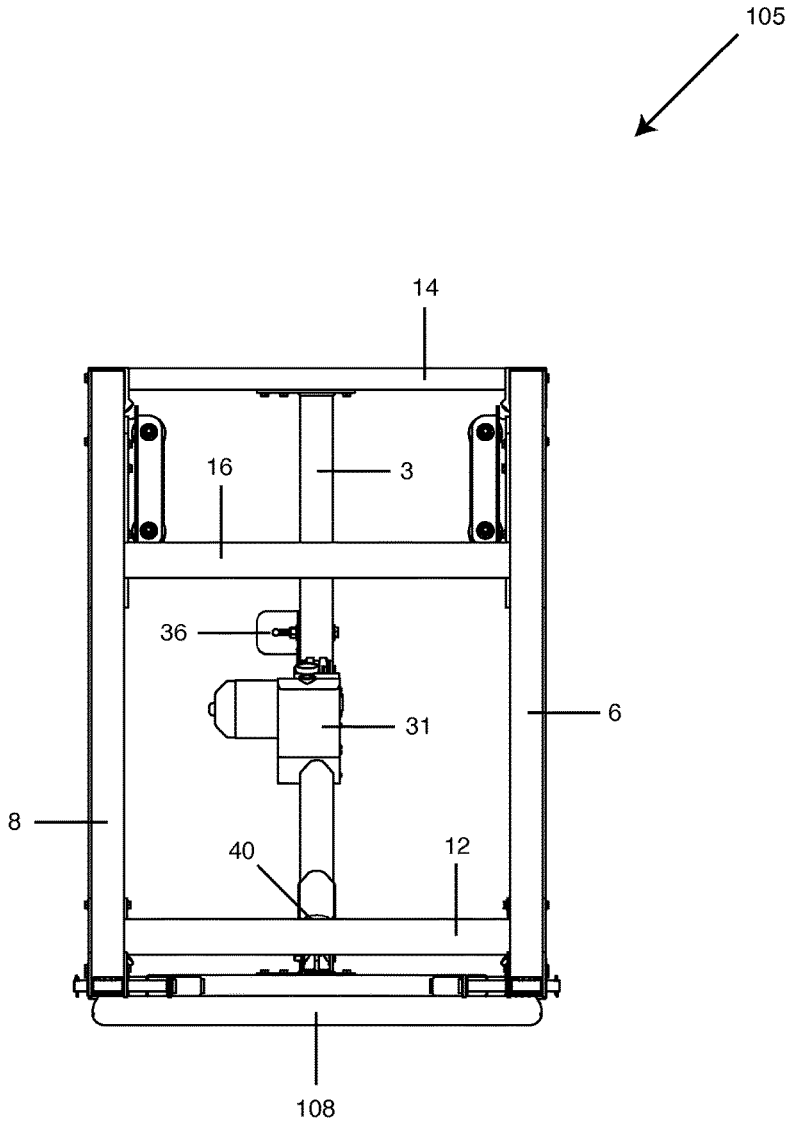
FIG. 9C of the drawings is a top plan view of a second embodiment of a frame sub-assembly fabricated in accordance with the present invention.
Figure 9D:
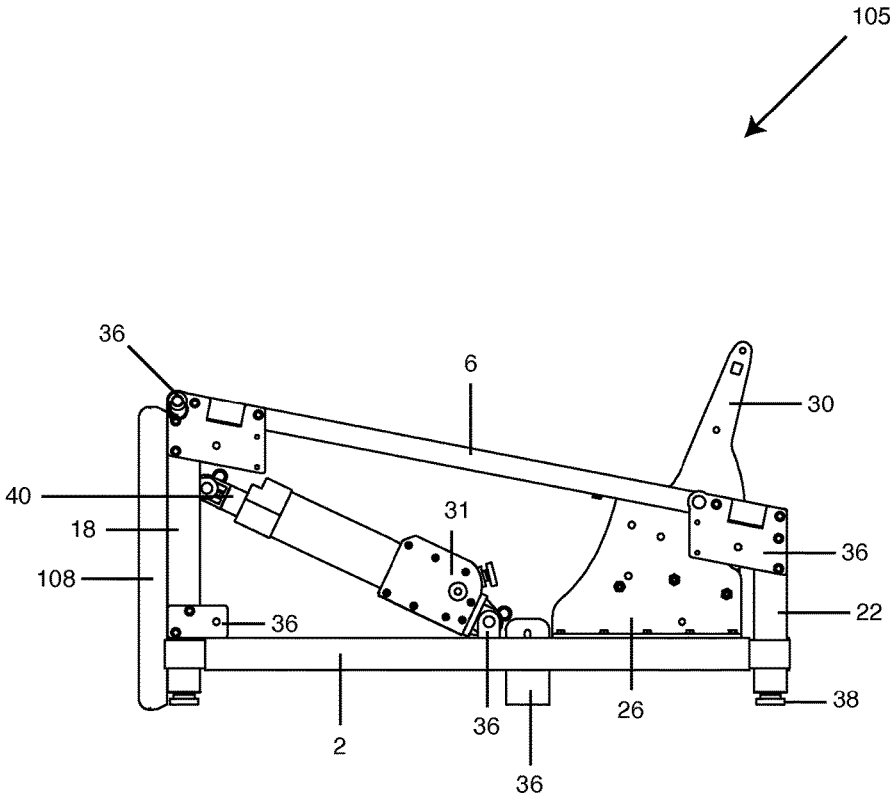
FIG. 9D of the drawings is a side view of a second embodiment of a frame sub-assembly fabricated in accordance with the present invention.

As is best shown in FIG. 8A, the upper end of substantially vertical front left support member 18 and the front end of upper left support member 6 are connected to form an acute angle, the upper end of substantially vertical front right support member 20 and the front end of upper right support member 8 are connected to form an acute angle, the upper end of substantially vertical rear left support member 22 and the rear end of upper left support member 6 are connected to form an obtuse angle, and the upper end of the substantially vertical rear right support member 24 and the rear end of upper right support member 8 are connected to form an obtuse angle.

As is also shown in FIG. 8A, the lower end of substantially vertical front left support member 18 and the front end of lower left support member 2 are connected to form a substantially right angle, the lower end of substantially vertical front right support member 20 and the front end of lower right support member 4 are connected to form a substantially right angle, the lower end of substantially vertical rear left support member 22 and the rear end of lower left support member 2 are connected to form a substantially right angle, and the lower end of substantially vertical rear right support member 24 and the rear end of lower right support member 4 are connected to form a substantially right angle.

Referring once again to FIGS. 8A-8D, floor-engaging frame sub-assembly 105 of cinema lounge chair 100 also includes left primary support bracket 26 and right primary support bracket 27, which are secured to lower left support member 2 and lower right support member 4, respectively, L-brackets 28 (n.b., left L-bracket 28 is not shown but is configured in an analogous manner to the right L-bracket 28 which is shown in FIGS. 8A-8B), left and right back and headrest support brackets 30 and rubber grommets 32 which are positioned between L-brackets 28, which are secured to left and right primary support brackets 26 and 27, and left and right back and headrest support brackets 30.

As is further shown in FIGS. 8A-8D, in this embodiment of the present invention, frame sub-assembly 105 preferably includes a plurality of brackets 36. Brackets 36 are secured to components of frame sub-assembly 105 via conventional fasteners and provide additional structural integrity to frame sub-assembly 105, as well as serve as mounting members for releasable securement of, for example, back and headrest support member 102, left arm 103, right arm 104, and front side 108. Frame sub-assembly 105 also includes a plurality of feet 38 which may be optionally substituted with floor brackets or anchors, pegs, casters, etcetera.

Referring now to FIGS. 1-5 and 9A-9D, a second embodiment of cinema lounge chair 100 is shown which generally comprises seat member 101, back and headrest support member 102, left arm 103, right arm 104, floor-engaging frame sub-assembly 105 (See FIGS. 9A-9D), left side 106, right side 107, leg rest 108, and back side 109. In this embodiment, back and headrest support member 102 of cinema lounge chair 100 includes a gentle rocking movement that is manually actuated by the theater patron or occupant, and an electric motor allows the leg and foot rest to be controllably (e.g., at generally infinite intervals) and lockably displaced between a retracted position and an extended position (FIGS. 5-7), all by the touch of one or more control buttons. Preferably, the control buttons are in mechanical/electrical communication with the electric motor and are positioned on the left arm or right arm.

In this embodiment of the present invention, and as is shown in FIGS. 9A-9D, cinema lounge chair 100 includes floor-engaging frame sub-assembly 105 which comprises lower left support member 2 having a front end and a rear end, lower middle support member 3 having a front end and a rear end, lower right support member 4 having a front end and a rear end, upper left support member 6 having a front end and a rear end, upper right support member 8 having a front end and a rear end, lower front support member 10 having a left end and a right end, upper front support member 12 having a left end and a right end, lower rear support member 14 having a left end and a right end, upper rear support member 16 having a left end and a right end, substantially vertical front left support member 18 having an upper end and a lower end, substantially vertical front right support member 20 having an upper end and a lower end, substantially vertical rear left support member 22 having an upper end and a lower end, substantially vertical rear right support member 24 having an upper end and a lower end, electric motor 31 (e.g., 24V Ilcon 406645), and leg rest sub-assembly 34.

In accordance with the present invention, leg rest sub-assembly 34 preferably comprises a generally rectangular frame that is pivotably mounted to the upper front portion of frame sub-assembly 105 via a pair of pin and sleeve mounts.

Lower middle support member 3 is secured to lower front support member 10 and lower rear support member 14. Electric motor 31 is mounted to lower middle support member 3. Electric motor 31 drives linearly displacement rod 40 which is secured to leg rest sub-assembly 34, and, in turn, controllably and lockably displaces leg and foot rest 108 between retracted and extended positions (FIG. 5). An AC/DC power supply (not shown) associated with electric motor 31 can be positioned on lower middle support member 3.

It will be understood that leg and foot rest 108 of cinema lounge chair 100 comprises a safety mechanism, whereby electric motor 31 includes a displacement restrictor that precludes leg and foot rest 108 from rapidly and/or undesirably being converted from an extended position to a retracted position, thus preventing injury to, for example, a child unknowingly positioned below leg and foot rest 108.

Referring once again to FIGS. 9A-9D, floor-engaging frame sub-assembly 105 of cinema lounge chair 100 also includes left primary support bracket 26 and right primary support bracket 27, which are secured to lower left support member 2 and lower right support member 4, respectively, L-brackets 28 (n.b., left L-bracket 28 is not shown but is configured in an analogous manner to the right L-bracket 28 which is shown in FIGS. 9A-9B), left and right back and headrest support brackets 30 and rubber grommets 32 which are positioned between L-brackets 28, which are secured to left and right primary support brackets 26 and 27, and left and right back and headrest support brackets 30.

As is further shown in FIGS. 9A-9D, in this embodiment of the present invention, frame sub-assembly 105 preferably includes a plurality of brackets 36. Brackets 36 are secured to components of frame sub-assembly 105 via conventional fasteners and provide additional structural integrity to frame sub-assembly 105, as well as serve as mounting members for releasable securement of, for example, back and headrest support member 102, left arm 103, right arm 104, and leg rest sub-assembly 34, and in turn, leg rest 108. Frame sub-assembly 105 also includes a plurality of feet 38 which may be optionally substituted with floor brackets or anchors, pegs, casters, etcetera.

Referring now to FIGS. 1-5 and 10A-10D, a third embodiment of cinema lounge chair 100 is shown which generally comprises seat member 101, back and headrest support member 102, left arm 103, right arm 104, floor-engaging frame sub-assembly 105 (See FIGS. 10A-10D), left side 106, right side 107, front side 108, and back side 109. In this embodiment, a hydraulic reclining mechanism allows back and headrest support member 102 to be controllably (e.g., at generally infinite intervals) displaced between an upright/retracted position and a reclined/extended position (FIGS. 5-7) and lock exactly where the occupant pleases, while using no electricity, all by the touch a control button. Preferably, the control button is in mechanical communication with the hydraulic reclining mechanism and is positioned on the left arm or right arm.

In this embodiment of the present invention, and as is shown in FIGS. 10A-10D, cinema lounge chair 100 includes floor-engaging frame sub-assembly 105 which comprises lower left support member 2 having a front end and a rear end, lower right support member 4 having a front end and a rear end, upper left support member 6 having a front end and a rear end, upper right support member 8 having a front end and a rear end, lower front support member 10 having a left end and a right end, secondary lower front support member 11 having a left end and a right end, upper front support member 12 having a left end and a right end, lower rear support member 14 having a left end and a right end, upper rear support member 16 having a left end and a right end, substantially vertical front left support member 18 having an upper end and a lower end, substantially vertical front right support member 20 having an upper end and a lower end, substantially vertical rear left support member 22 having an upper end and a lower end, substantially vertical rear right support member 24 having an upper end and a lower end, and hydraulic cylinder 42 (e.g., P.L. Porter Hydrolock HL28600-00).

Figure 10A:
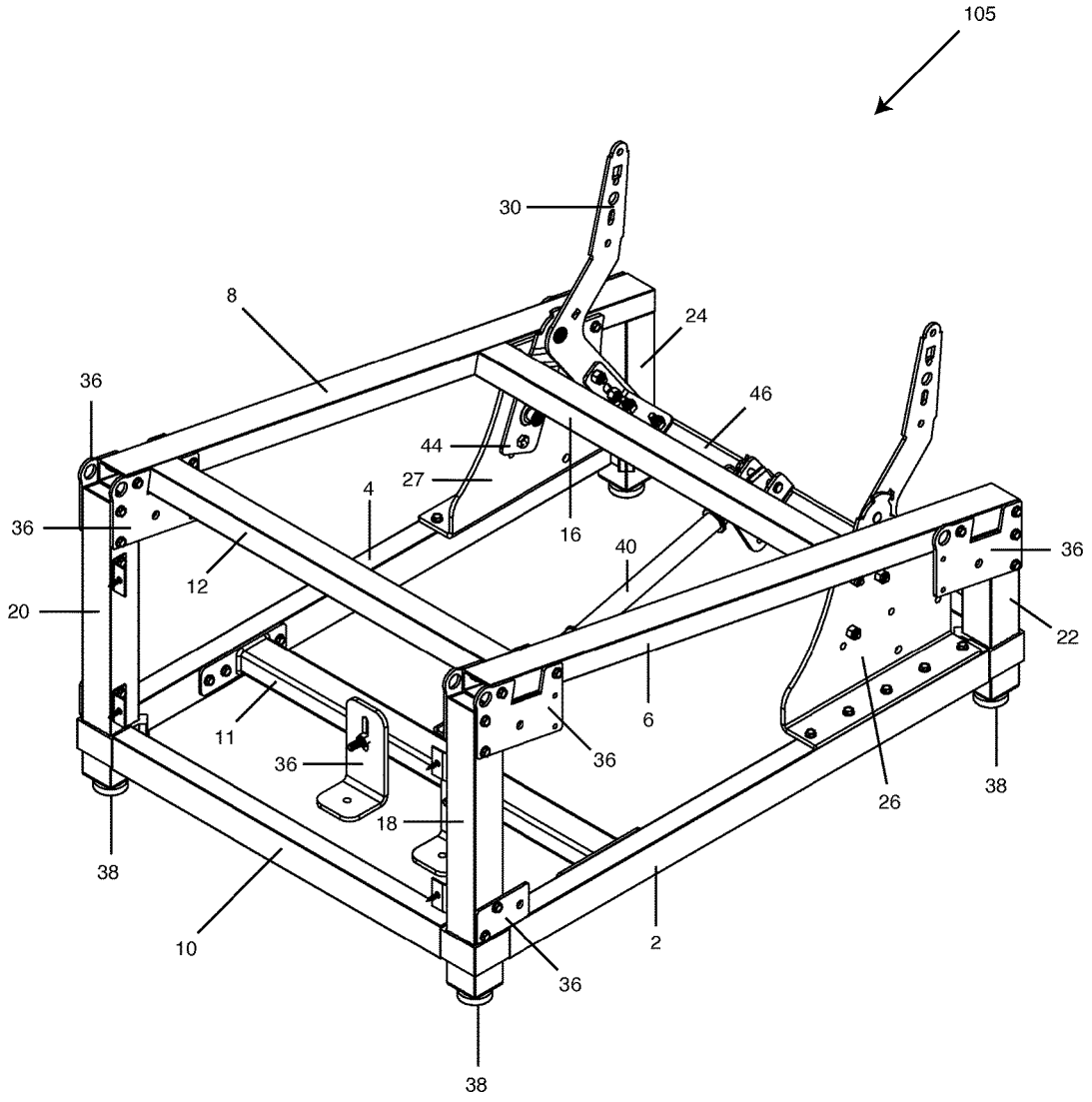
FIG. 10A of the drawings is an isometric view of a third embodiment of a frame sub-assembly fabricated in accordance with the present invention.
Figure 10B:
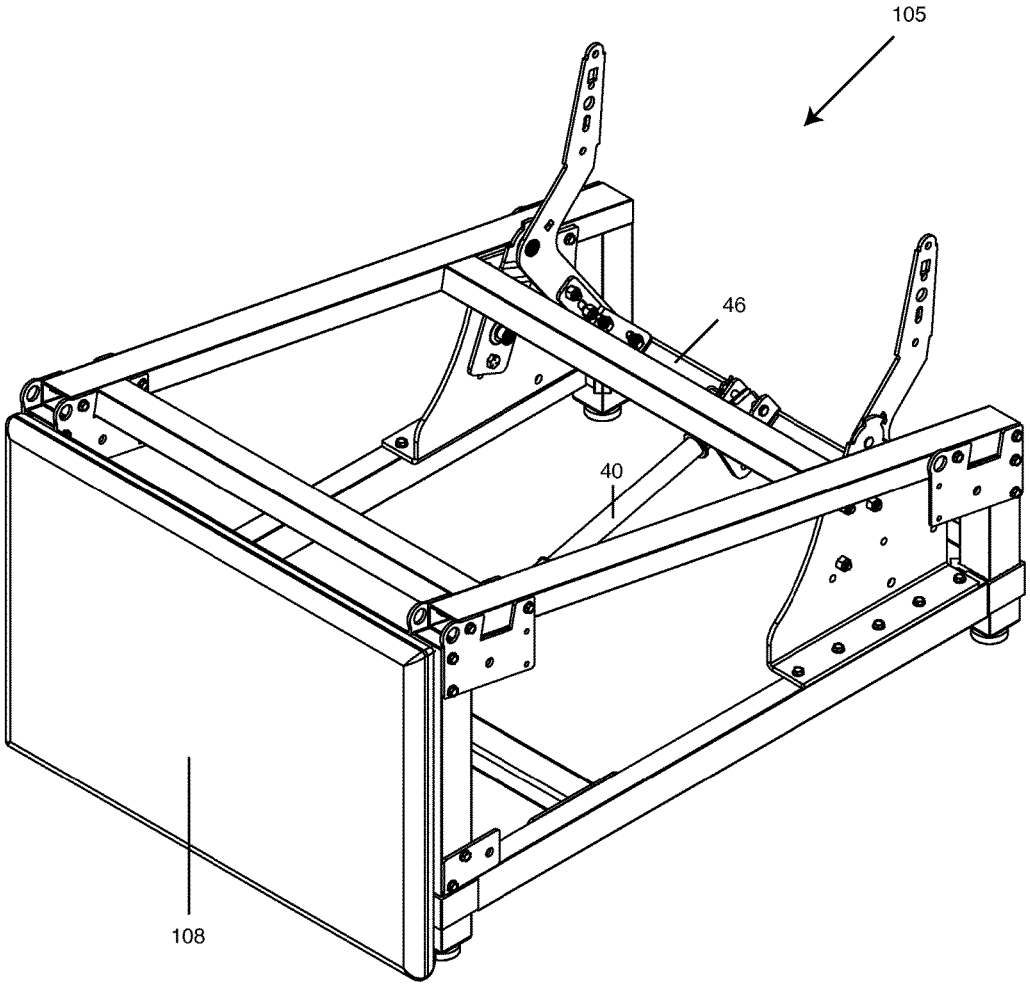
FIG. 10B of the drawings is an isometric view of a third embodiment of a frame sub-assembly fabricated in accordance with the present invention showing a front member secured thereto.
Figure 10C:
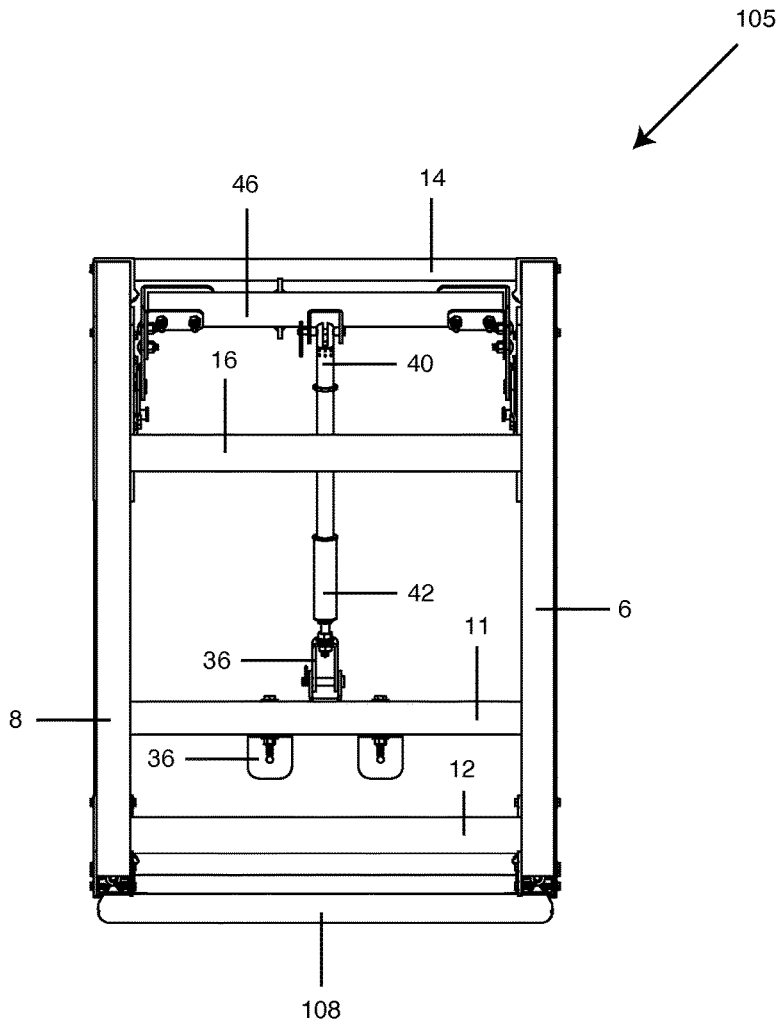
FIG. 10C of the drawings is a top plan view of a third embodiment of a frame sub-assembly fabricated in accordance with the present invention.
Figure 10D:
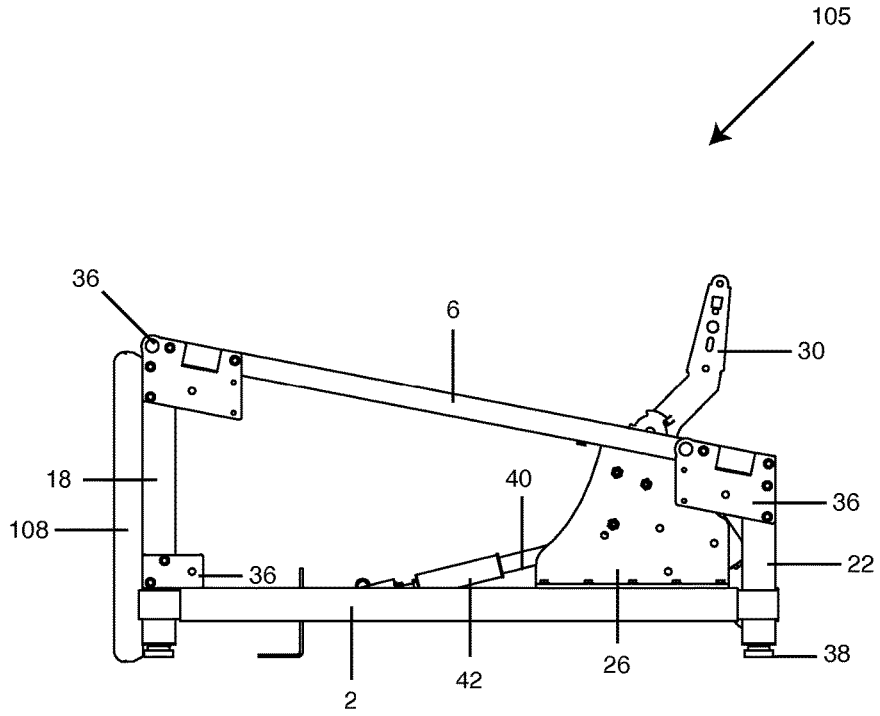
FIG. 10D of the drawings is a side view of a third embodiment of a frame sub-assembly fabricated in accordance with the present invention.

Floor-engaging frame sub-assembly 105 of cinema lounge chair 100 also includes left and right primary support brackets 26 and 27, which are secured to lower left and right support members 2 and 4, respectively, pivot brackets 44, (n.b., the left pivot bracket is not shown but is configured in an analogous manner to the right pivot bracket which is shown in FIGS. 10A-10B) left and right back and headrest support brackets 30, and coupling member 46.

Secondary lower front support member 11 is secured to lower left support member 2 and lower right support member 4. Hydraulic cylinder 42 is pivotably mounted to secondary lower front support member 11 and coupling member 46 which, is, in turn secured to left and right back and headrest support brackets 30. Hydraulic cylinder 42 drives linearly displacement rod 40 which is secured to coupling member 46, and, in turn, controllably and lockably displaces back and headrest support member 102 between upright and reclined positions.

As is further shown in FIGS. 10A-10B, in this embodiment of the present invention, frame sub-assembly 105 preferably includes a plurality of brackets 36. Brackets 36 are secured to components of frame sub-assembly 105 via conventional fasteners and provide additional structural integrity to frame sub-assembly 105, as well as serve as mounting members for releasable securement of, for example, back and headrest support member 102, left arm 103, right arm 104, and leg rest sub-assembly 34, and in turn, leg rest 108. Frame sub-assembly 105 also includes a plurality of feet 38 which may be optionally substituted with floor brackets or anchors, pegs, casters, etcetera.

Referring now to FIGS. 1-5 and 11A-11D, a fourth embodiment of cinema lounge chair 100 is shown which generally comprises seat member 101, back and headrest support member 102, left arm 103, right arm 104, floor-engaging frame sub-assembly 105 (See FIGS. 11A-11D), left side 106, right side 107, leg rest 108, and back side 109. In this embodiment, a hydraulic reclining mechanism allows, in unison, back and headrest support member 102 and leg rest 108 to be controllably (e.g., at generally infinite intervals) displaced between upright/retracted positions and reclined/extended positions and lock exactly where the occupant pleases, while using no electricity, all by the touch a control button. Preferably, the control button is in mechanical communication with the hydraulic reclining mechanism and is positioned on the left arm or right arm.

In this embodiment of the present invention, and as is shown in FIGS. 11A-11D, cinema lounge chair 100 includes floor-engaging frame sub-assembly 105 which comprises lower left support member 2 having a front end and a rear end, lower right support member 4 having a front end and a rear end, upper left support member 6 having a front end and a rear end, upper right support member 8 having a front end and a rear end, lower front support member 10 having a left end and a right end, secondary lower front support member 11 having a left end and a right end, upper front support member 12 having a left end and a right end, lower rear support member 14 having a left end and a right end, upper rear support member 16 having a left end and a right end, substantially vertical front left support member 18 having an upper end and a lower end, substantially vertical front right support member 20 having an upper end and a lower end, substantially vertical rear left support member 22 having an upper end and a lower end, substantially vertical rear right support member 24 having an upper end and a lower end, hydraulic cylinder 42 (e.g., P.L. Porter Hydrolock HL28600-00), and strut assembly 48.

Floor-engaging frame sub-assembly 105 of cinema lounge chair 100 also includes left and right primary support brackets 26 and 27, which are secured to lower left and right support members 2 and 4, respectively, pivot brackets 44, (n.b., the left pivot bracket is not shown but is configured in an analogous manner to the right bracket which is shown in FIGS. 10A-10B) left and right back and headrest support brackets 30, and coupling member 46.

Secondary lower front support member 11 is secured to lower left support member 2 and lower right support member 4. Hydraulic cylinder 42 is pivotably mounted to secondary lower front support member 11 and coupling member 46 which, is, in turn secured to left and right back and headrest support brackets 30. Hydraulic cylinder 42 drives linearly displacement rod 40 which is secured to coupling member 46, and, in turn, controllably and lockably displaces back and headrest support member 102 between upright and reclined positions. Simultaneously, as coupling member 46 is displaced by rod 40, strut rod 49 of strut assembly 48 displaces leg rest 108.

It will be understood that leg rest 108 of cinema lounge chair 100 comprises a safety mechanism, whereby strut assembly 48 includes a back pressure displacement restrictor that precludes leg rest 108 from rapidly and/or undesirably being converted from an extended position to a retracted position, thus preventing injury to, for example, a child unknowingly positioned below leg rest 108.

Figure 11A:
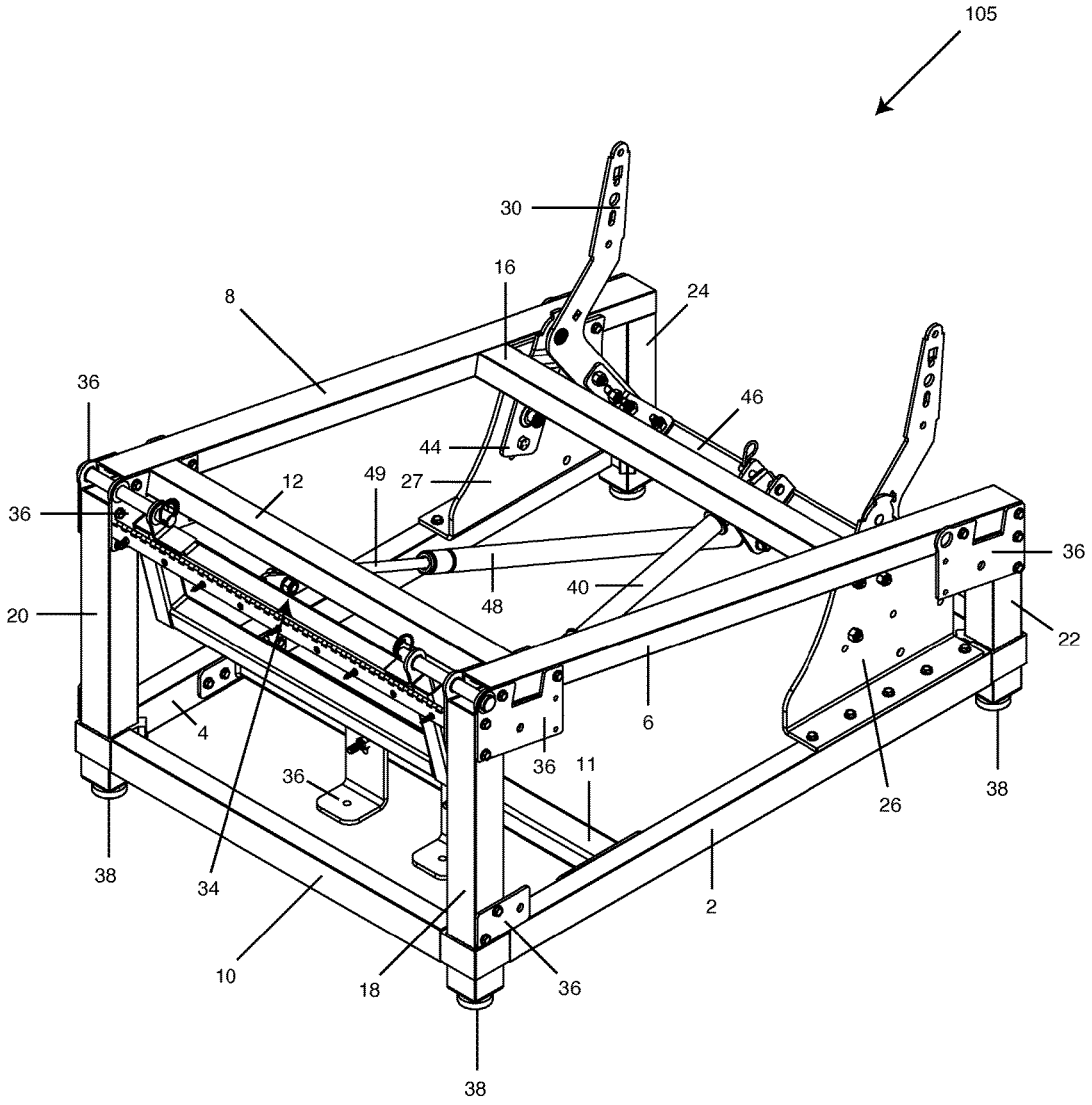
FIG. 11A of the drawings is an isometric view of a fourth embodiment of a frame sub-assembly fabricated in accordance with the present invention.
Figure 11B:
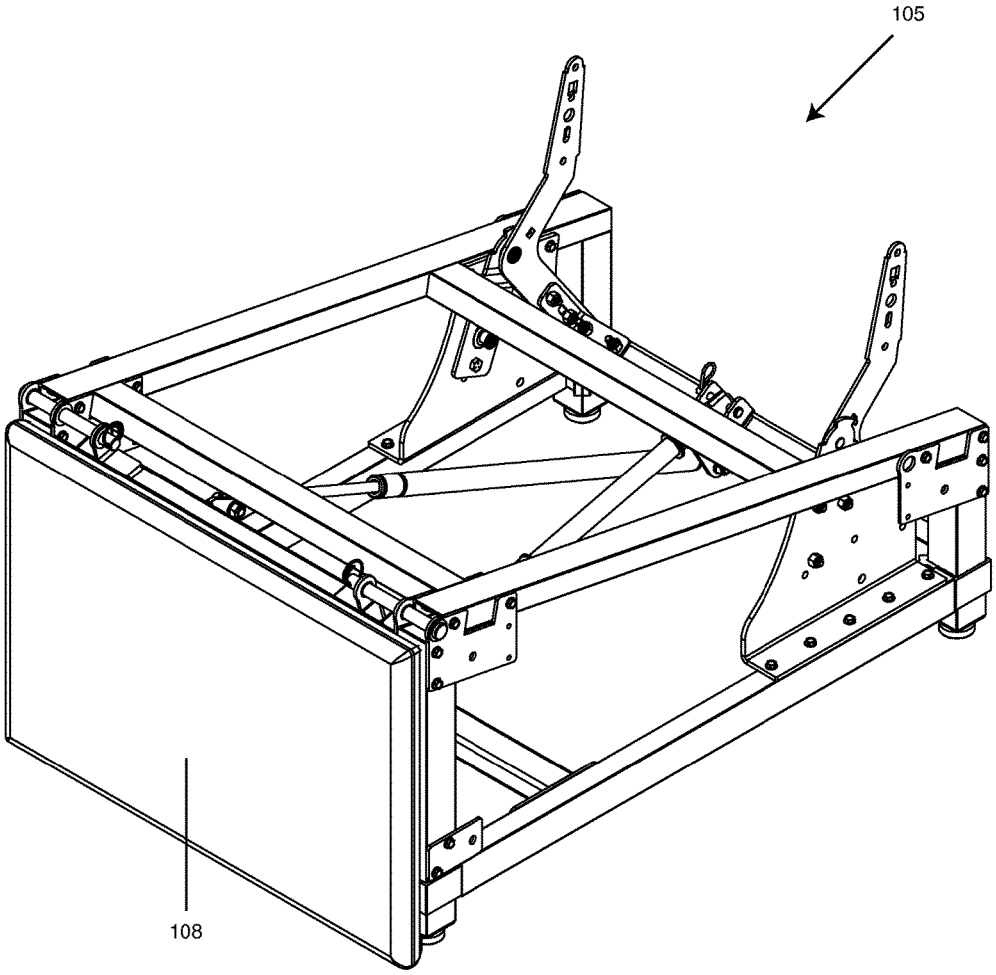
FIG. 11B of the drawings is an isometric view of a fourth embodiment of a frame sub-assembly fabricated in accordance with the present invention showing a leg rest associated therewith.
Figure 11C:
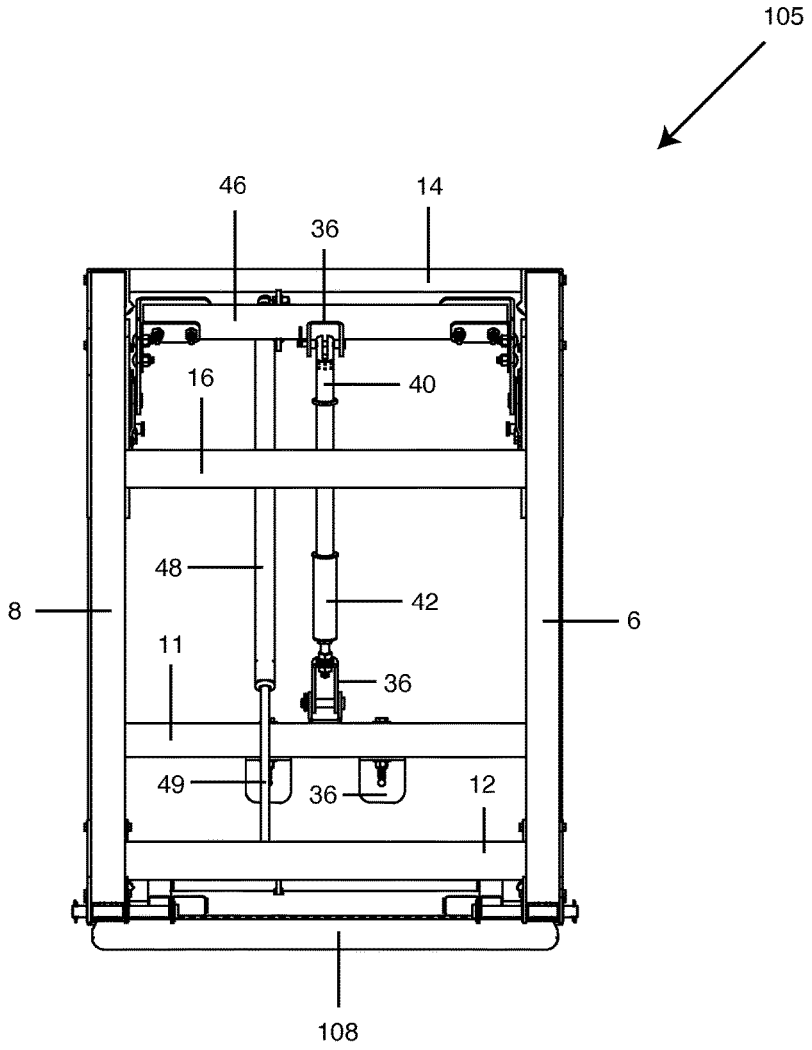
FIG. 11C of the drawings is a top plan view of a fourth embodiment of a frame sub-assembly fabricated in accordance with the present invention.
Figure 11D:
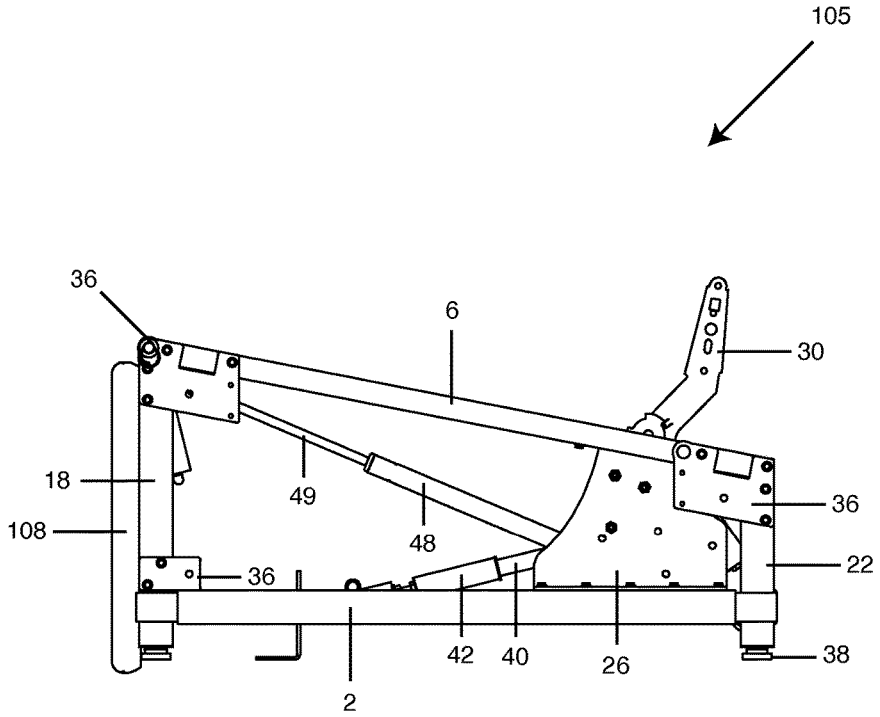
FIG. 11D of the drawings is a side view of a fourth embodiment of a frame sub-assembly fabricated in accordance with the present invention.

As is further shown in FIGS. 11A-11B, in this embodiment of the present invention, frame sub-assembly 105 preferably includes a plurality of brackets 36. Brackets 36 are secured to components of frame sub-assembly 105 via conventional fasteners and provide additional structural integrity to frame sub-assembly 105, as well as serve as mounting members for releasable securement of, for example, back and headrest support member 102, left arm 103, right arm 104, and leg rest sub-assembly 34, and in turn, leg rest 108. Frame sub-assembly 105 also includes a plurality of feet 38 which may be optionally substituted with floor brackets or anchors, pegs, casters, etcetera.

Referring now to FIGS. 1-5 and 12A-12D, a fifth embodiment of cinema lounge chair 100 is shown which generally comprises seat member 101, back and headrest support member 102, left arm 103, right arm 104, floor-engaging frame sub-assembly 105 (See FIGS. 12A-12D), left side 106, right side 107, leg rest 108, and back side 109. In this embodiment, electric motor 31 both allows back and headrest support member 102 and leg rest 108 to be controllably (e.g., at generally infinite intervals) and lockably displaced between upright/retracted positions and reclined/extended positions (FIGS. 5-7), all by the touch of one or more control buttons. Preferably, the control buttons are in mechanical/electrical communication with the electric motor and are positioned on the left arm or right arm.

In this embodiment of the present invention, and as is shown in FIGS. 12A-12D, cinema lounge chair 100 includes floor-engaging frame sub-assembly 105 which comprises lower left support member 2 having a front end and a rear end, lower right support member 4 having a front end and a rear end, upper left support member 6 having a front end and a rear end, upper right support member 8 having a front end and a rear end, lower front support member 10 having a left end and a right end, secondary lower front support member 11 having a left end and a right end, upper front support member 12 having a left end and a right end, lower rear support member 14 having a left end and a right end, upper rear support member 16 having a left end and a right end, substantially vertical front left support member 18 having an upper end and a lower end, substantially vertical front right support member 20 having an upper end and a lower end, substantially vertical rear left support member 22 having an upper end and a lower end, substantially vertical rear right support member 24 having an upper end and a lower end, electric motor 31 (e.g., 24V Ilcon 406645), and strut assembly 48.

Figure 12A:
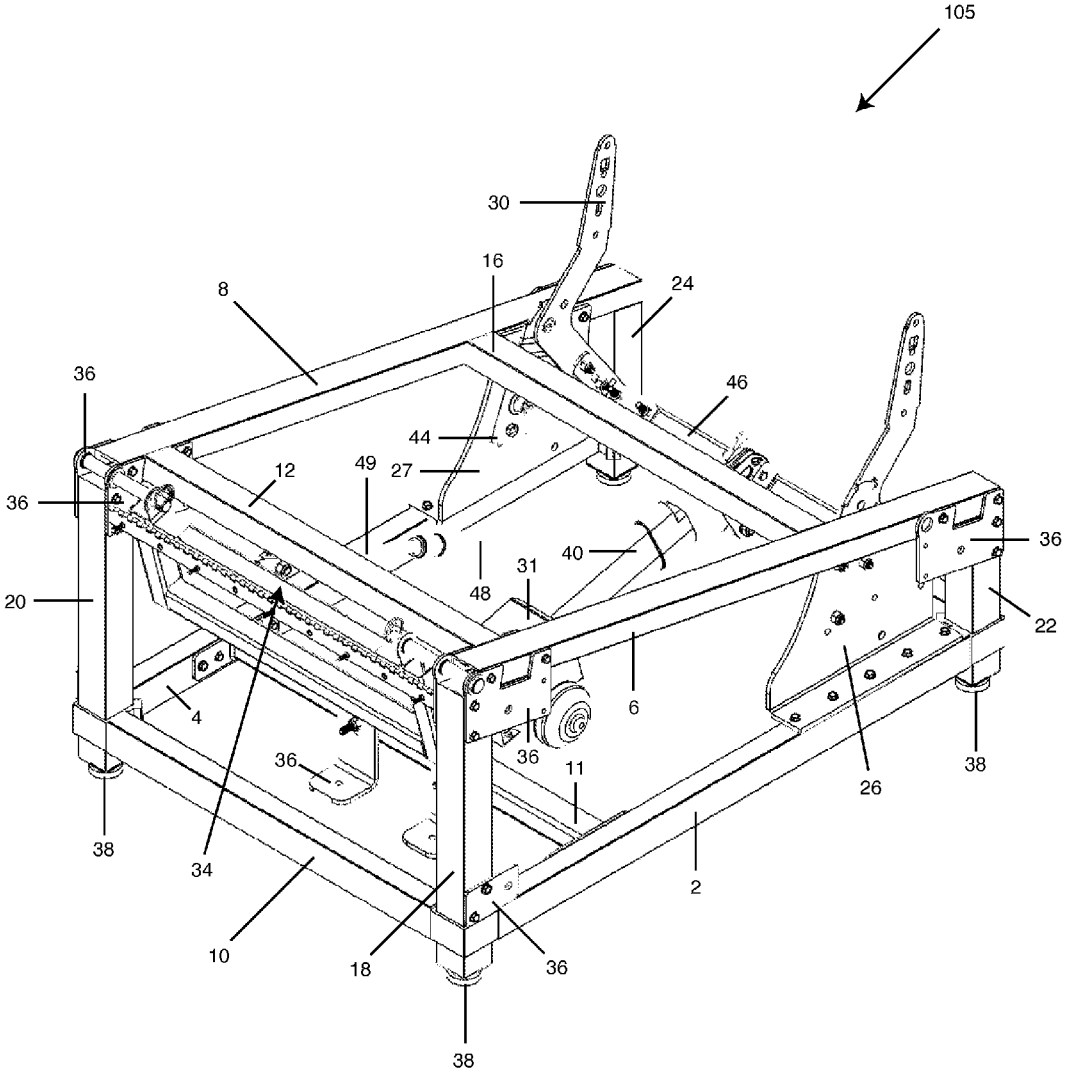
FIG. 12A of the drawings is an isometric view of a fifth embodiment of a frame sub-assembly fabricated in accordance with the present invention.
Figure 12B:
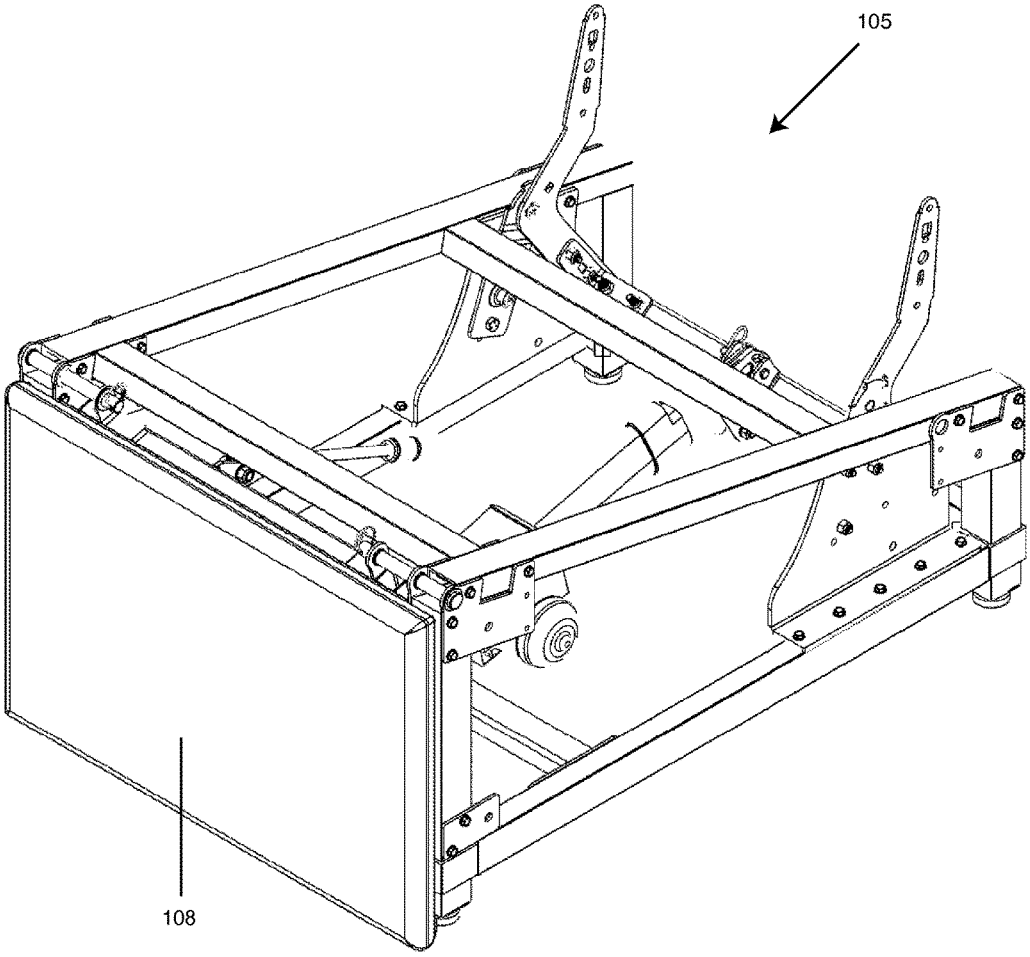
FIG. 12B of the drawings is an isometric view of a fifth embodiment of a frame sub-assembly fabricated in accordance with the present invention showing a leg rest associated therewith.
Figure 12C:
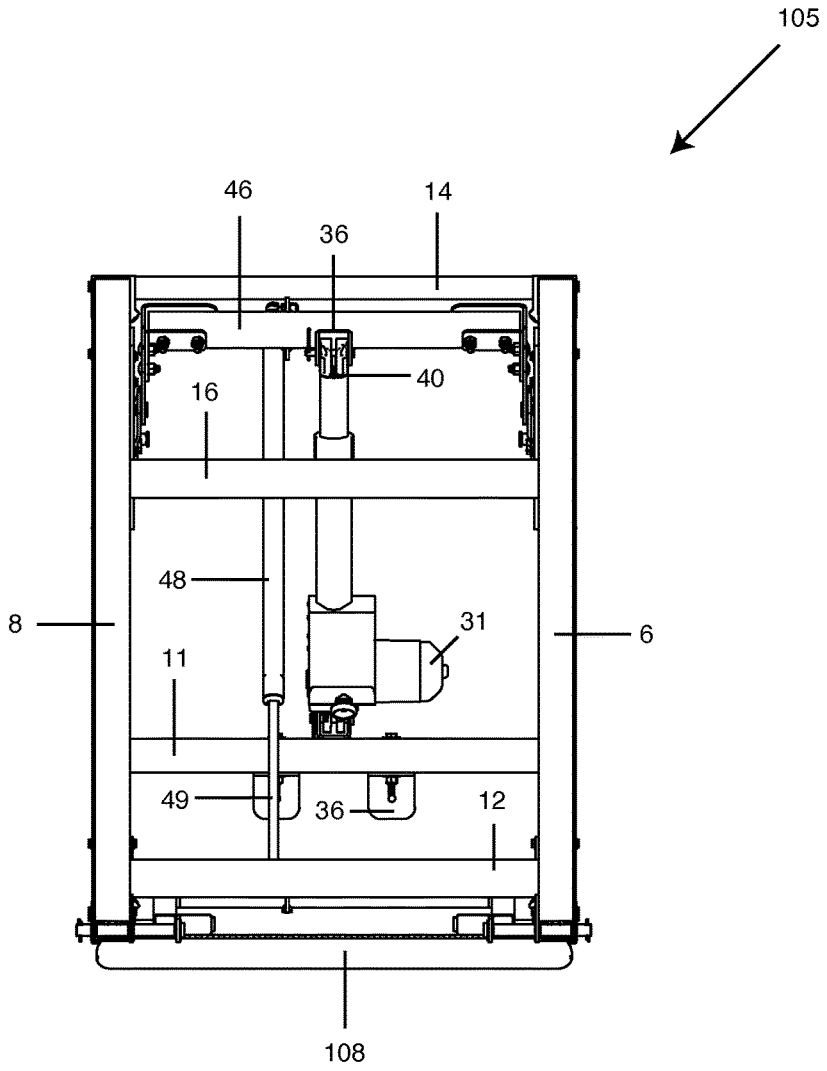
FIG. 12C of the drawings is a top plan view of a fifth embodiment of a frame sub-assembly fabricated in accordance with the present invention.
Figure 12D:
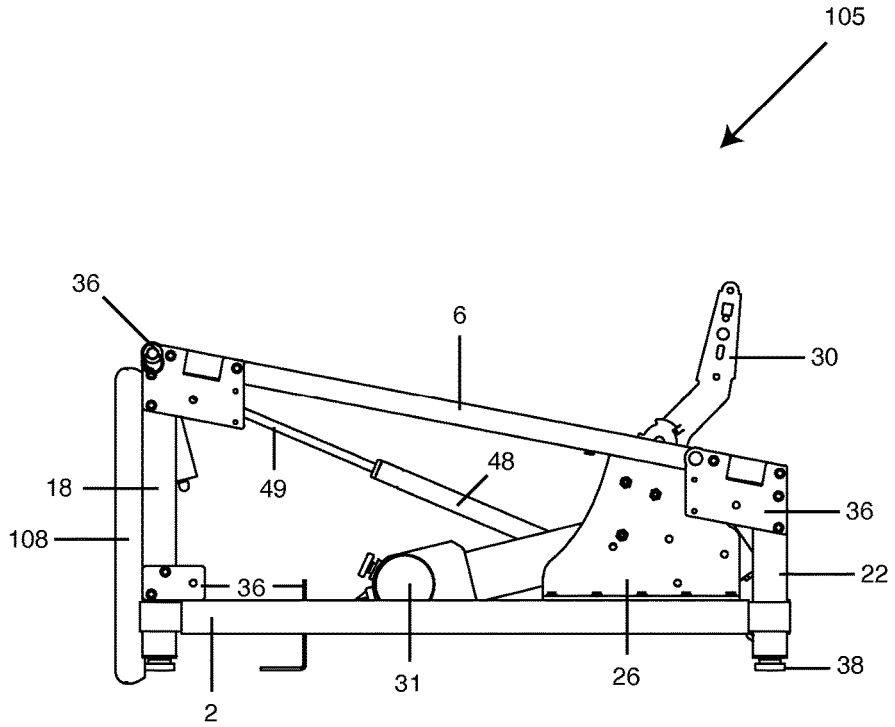
FIG. 12D of the drawings is a side view of a fifth embodiment of a frame sub-assembly fabricated in accordance with the present invention.

Floor-engaging frame sub-assembly 105 of cinema lounge chair 100 also includes left and right primary support brackets 26 and 27, which are secured to lower left and right support members 2 and 4, respectively, pivot brackets 44, (n.b., the left pivot bracket is not shown but is configured in an analogous manner to the right bracket which is shown in FIGS. 12A-12B) left and right back and headrest support brackets 30, and coupling member 46.

Secondary lower front support member 11 is secured to lower left support member 2 and lower right support member 4. Electric motor 31 is pivotably mounted to secondary lower front support member 11 and coupling member 46 which, is, in turn secured to left and right back and headrest support brackets 30. Electric motor 31 drives linearly displacement rod 40 which is secured to coupling member 46, and, in turn, controllably and lockably displaces back and headrest support member 102 between upright and reclined positions. Simultaneously, as coupling member 46 is displaced by rod 40, strut rod 49 of strut assembly 48 displaces leg rest 108.

It will be understood that leg rest 108 of cinema lounge chair 100 comprises a safety mechanism, whereby strut assembly 48 includes a back pressure displacement restrictor that precludes leg rest 108 from rapidly and/or undesirably being converted from an extended position to a retracted position, thus preventing injury to, for example, a child unknowingly positioned below leg rest 108.

As is further shown in FIGS. 12A-12B, in this embodiment of the present invention, frame sub-assembly 105 preferably includes a plurality of brackets 36. Brackets 36 are secured to components of frame sub-assembly 105 via conventional fasteners and provide additional structural integrity to frame sub-assembly 105, as well as serve as mounting members for releasable securement of, for example, back and headrest support member 102, left arm 103, right arm 104, and leg rest sub-assembly 34, and in turn, leg rest 108. Frame sub-assembly 105 also includes a plurality of feet 38 which may be optionally substituted with floor brackets or anchors, pegs, casters, etcetera.

Referring now to FIGS. 1-5 and 13A-13D, a sixth embodiment of cinema lounge chair 100 is shown which generally comprises seat member 101, back and headrest support member 102, left arm 103, right arm 104, floor-engaging frame sub-assembly 105 (See FIGS. 13A-13D), left side 106, right side 107, leg rest 108, and back side 109. In this embodiment, a pair of independently operating electric motors 31 allows back and headrest support member 102 to be controllably (e.g., at generally infinite intervals) and lockably displaced between an upright position and a reclined position (FIG. 5), and leg rest 108 to be controllably (e.g., at generally infinite intervals) and lockably displaced between an retracted position and an extended position (FIG. 5), all by the touch of two or more control buttons. Preferably, the control buttons are in mechanical/electrical communication with the electric motors and are positioned on the left arm or right arm.

In this embodiment of the present invention, and as is shown in FIGS. 13A-13D, cinema lounge chair 100 includes floor-engaging frame sub-assembly 105 which comprises lower left support member 2 having a front end and a rear end, lower middle support member 3 having a front end and a rear end, lower right support member 4 having a front end and a rear end, upper left support member 6 having a front end and a rear end, upper right support member 8 having a front end and a rear end, lower front support member 10 having a left end and a right end, secondary lower front support member 11 having a left end and a right end, upper front support member 12 having a left end and a right end, lower rear support member 14 having a left end and a right end, upper rear support member 16 having a left end and a right end, substantially vertical front left support member 18 having an upper end and a lower end, substantially vertical front right support member 20 having an upper end and a lower end, substantially vertical rear left support member 22 having an upper end and a lower end, substantially vertical rear right support member 24 having an upper end and a lower end, and a pair of electric motors 31 (e.g., 24V Ilcon 406645).

Figure 13A:
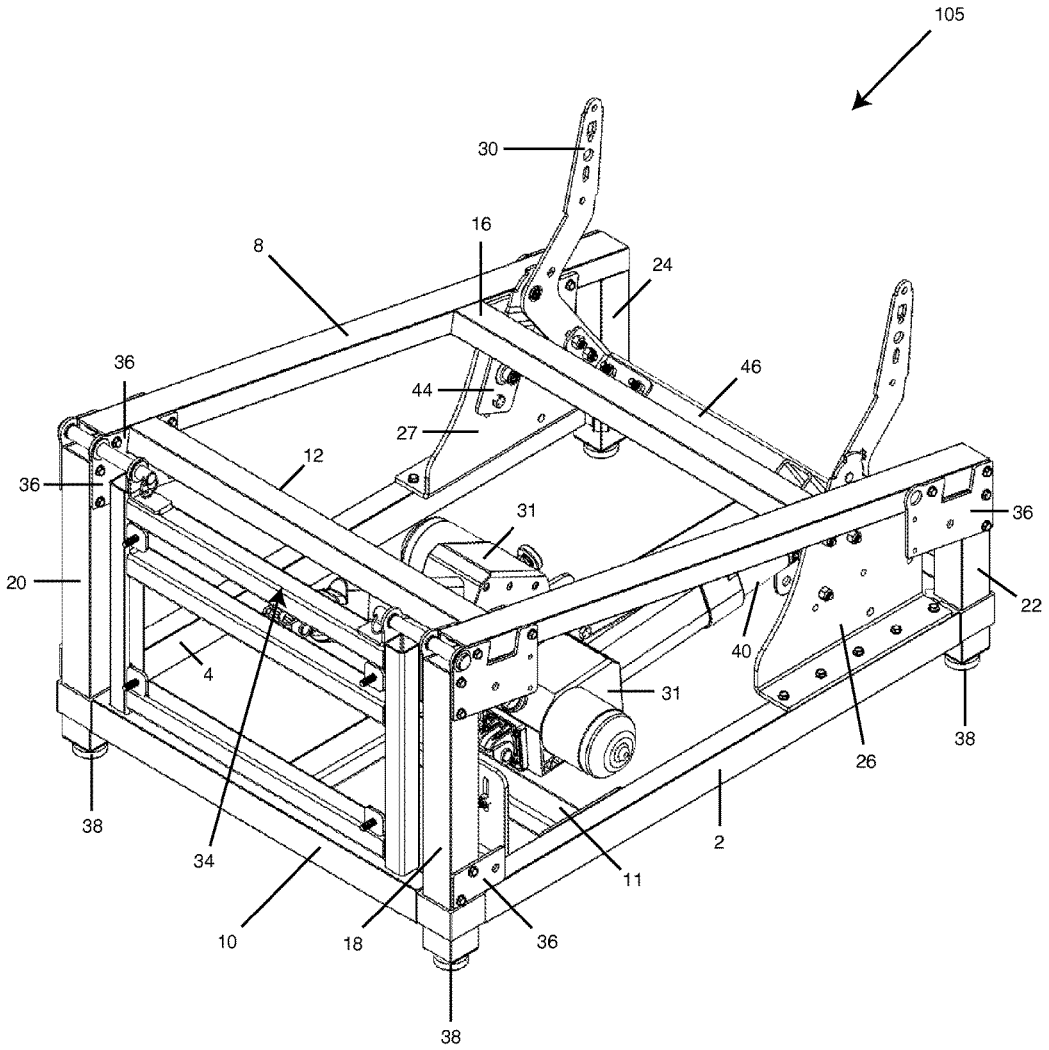
FIG. 13A of the drawings is an isometric view of a sixth embodiment of a frame sub-assembly fabricated in accordance with the present invention.
Figure 13B:
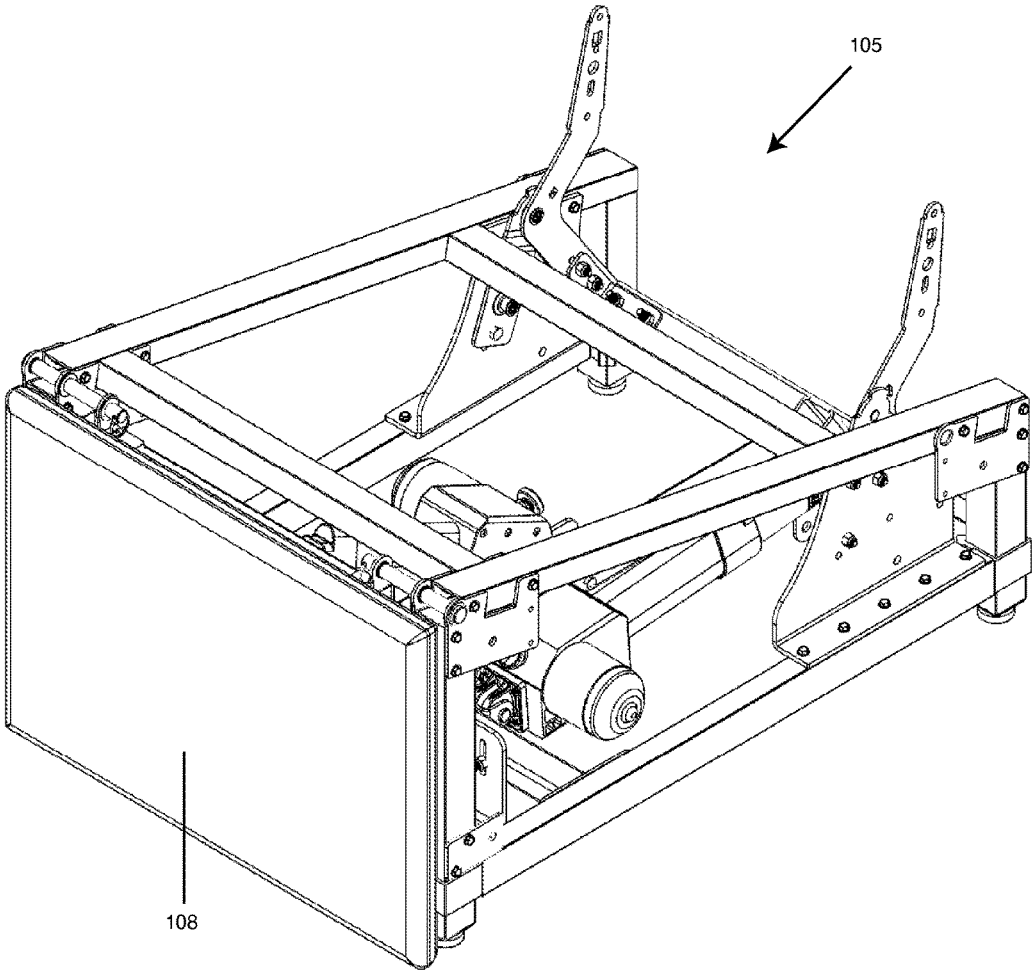
FIG. 13B of the drawings is an isometric view of a sixth embodiment of a frame sub-assembly fabricated in accordance with the present invention showing a leg rest associated therewith.
Figure 13C:
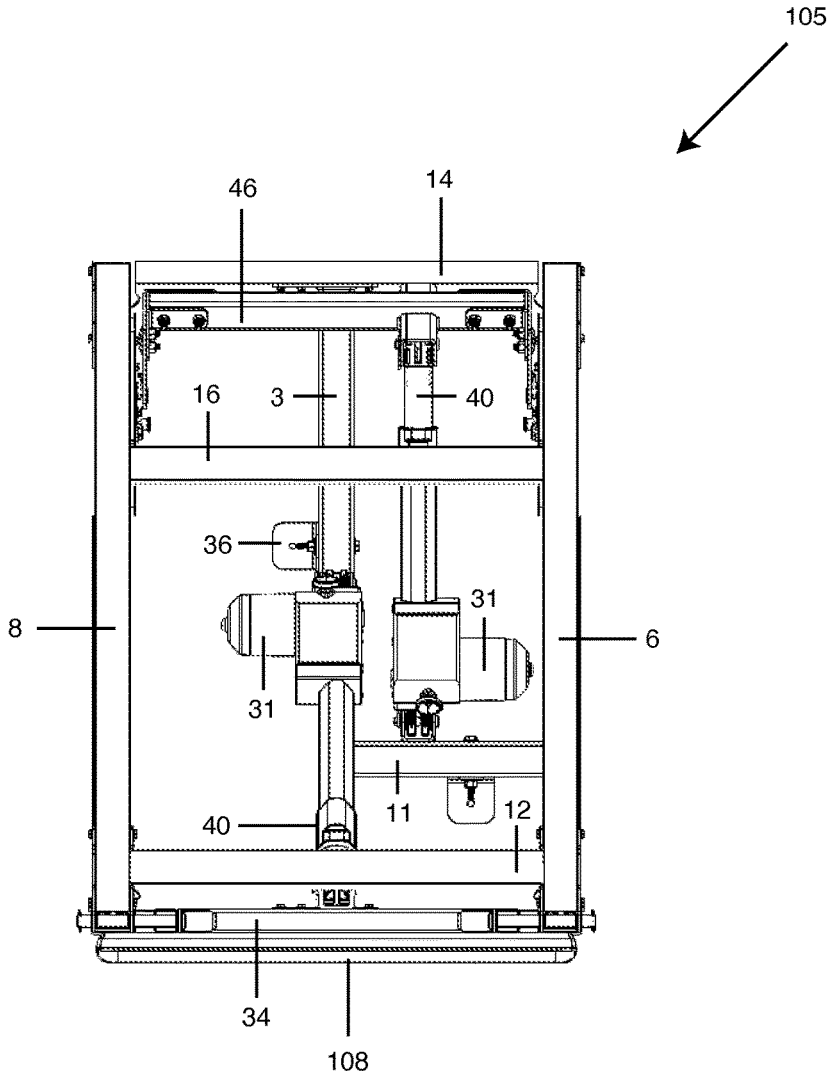
FIG. 13C of the drawings is a top plan view of a sixth embodiment of a frame sub-assembly fabricated in accordance with the present invention.
Figure 13D:
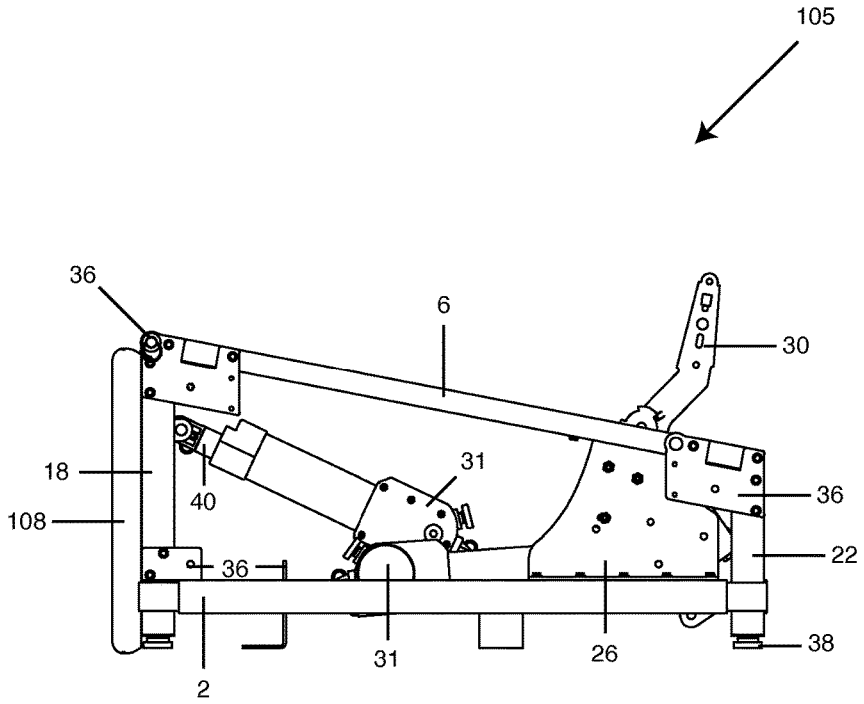
FIG. 13D of the drawings is a side view of a sixth embodiment of a frame sub-assembly fabricated in accordance with the present invention.

Floor-engaging frame sub-assembly 105 of cinema lounge chair 100 also includes left and right primary support brackets 26 and 27, which are secured to lower left and right support members 2 and 4, respectively, pivot brackets 44, (n.b., the left pivot bracket is not shown but is configured in an analogous manner to the right bracket which is shown in FIGS. 13A-13B) left and right back and headrest support brackets 30, and coupling member 46.

Lower middle support member 3 is secured to lower front support member 10 and lower rear support member 14. Electric motor 31 is mounted to lower middle support member 3. Electric motor 31 drives linearly displacement rod 40 which is secured to leg rest sub-assembly 34, and, in turn, controllably and lockably displaces leg rest 108 between retracted and extended positions (FIG. 5). An AC/DC power supply (not shown) associated with electric motor 31 can be positioned on lower middle support member 3. Secondary lower front support member 11 is secured to lower left support member 2 and lower middle support member 3. Electric motor 31 is pivotably mounted to secondary lower front support member 11 and coupling member 46 which, is, in turn secured to left and right back and headrest support brackets 30. Electric motor 31 drives linearly displacement rod 40 which is secured to coupling member 46, and, in turn, controllably and lockably displaces back and headrest support member 102 between upright and reclined positions.

It will be understood that leg rest 108 of cinema lounge chair 100 comprises a safety mechanism, whereby electric motor 31 includes a displacement restrictor that precludes leg rest 108 from rapidly and/or undesirably being converted from an extended position to a retracted position, thus preventing injury to, for example, a child unknowingly positioned below leg rest 108.

As is further shown in FIGS. 13A-13D, in this embodiment of the present invention, frame sub-assembly 105 preferably includes a plurality of brackets 36. Brackets 36 are secured to components of frame sub-assembly 105 via conventional fasteners and provide additional structural integrity to frame sub-assembly 105, as well as serve as mounting members for releasable securement of, for example, back and headrest support member 102, left arm 103, right arm 104, and leg rest sub-assembly 34, and in turn, leg rest 108. Frame sub-assembly 105 also includes a plurality of feet 38 which may be optionally substituted with floor brackets or anchors, pegs, casters, etcetera.

In accordance with the present invention, frame sub-assembly 105 preferably comprises one or more compression-friction fit joints. Furthermore, frame sub-assembly 105 is preferably fabricated from metals including, aluminum, alloys of aluminum and other metals, steel, as well as natural and synthetic plastic resins.

In further accordance with the present invention, hybrid cinema lounge chair assemblies are likewise contemplated for use, wherein displacement of the back support member/headrest and/or the foot/leg rest of the cinema lounge chair assembly are independently or simultaneously controllably and lockably displaceable between an upright/retracted positions and reclined/extended positions via one or more electric motors and one or more hydraulic mechanisms associated with the frame sub-assembly.

The cinema lounge chairs of the present invention may also comprise one or more safety features (e.g., guard members, brake mechanisms, lighting members, etcetera), as well as one more accessory items (e.g., beverage holders, 3-D glass holders, pockets, tray members, audio output jacks, sensory output members, such as vibration inducing members, rotary actuating members, etcetera).

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A modular cinema lounge chair, comprising:

a seat member, a back and headrest support member, a left arm, a right arm, a floor-engaging frame sub-assembly, a left side, a right side, a front side/leg rest, and a back side;

wherein the floor-engaging frame sub-assembly comprises a lower left support member having an upper surface, a left primary support bracket having an inner surface, wherein the left primary support bracket is secured to the upper surface of the lower left support member, a first L-bracket having an upper surface, wherein the first L-bracket is secured to the inner surface of the left primary support bracket, a first rubber grommet and a second rubber grommet positioned in a spaced apart relationship, wherein the first and second rubber grommets contact the upper surface of the first L-bracket, a left back and headrest support bracket, wherein the left back and headrest support bracket is secured to the first and second rubber grommets;

wherein the floor-engaging frame sub-assembly comprises a lower right support member having an upper surface, a right primary support bracket having an inner surface, wherein the right primary support bracket is secured to the upper surface of the lower right support member, a second L-bracket having an upper surface, wherein the second L-bracket is secured to the inner surface of the right primary support bracket, a third rubber grommet and a fourth rubber grommet positioned in a spaced apart relationship, wherein the third and fourth rubber grommets contact the upper surface of the second L-bracket, a right back and headrest support bracket, wherein the right back and headrest support bracket is secured to the third and fourth rubber grommets; and wherein the back and headrest support member is rockably displaceable between an upright position and a reclined position.

2. The modular cinema lounge chair according to claim 1, wherein the frame sub-assembly comprises an electric motor.

3. The modular cinema lounge chair according to claim 2, wherein the electric motor is secured to a lower middle support member and a foot rest sub-assembly.

4. The modular cinema lounge chair according to claim 1, further comprising a lower rear support member having an inner surface, a lower front support member having an inner surface, and a lower middle support member, wherein the lower middle support member is positioned orthogonal to the lower rear support member and the lower front support member, and is secured to the inner surface of the lower rear support member and the inner surface of the lower front support member, and an electric motor mounted to the lower middle support member, wherein the electric motor drives a linearly displacement rod which is secured to a leg rest sub-assembly, and, in turn, controllably and lockably displaces a leg and foot rest between retracted and extended positions.

5. A modular cinema lounge chair, comprising:

a seat member, a back and headrest support member, a left arm, a right arm, a floor-engaging frame sub-assembly, a left side, a right side, a front side/leg rest, and a back side;

wherein the frame sub-assembly comprises a lower left support member having a front end and a rear end, a lower right support member having a front end and a rear end, an upper left support member having a front end and a rear end, an upper right support member having a front end and a rear end, a lower front support member having a left end and a right end, an upper front support member having a left end and a right end, a lower rear support member having a left end and a right end, an upper rear support member having a left end and a right end, a substantially vertical front left support member having an upper end and a lower end, a substantially vertical front right support member having an upper end and a lower end, a substantially vertical rear left support member having an upper end and a lower end, and a substantially vertical rear right support member having an upper end and a lower end;

wherein the upper end of the substantially vertical front left support member and the front end of the upper left support member are connected to form an acute angle, wherein the upper end of the substantially vertical front right support member and the front end of the upper right support member are connected to form an acute angle, wherein the upper end of the substantially vertical rear left support member and the rear end of the upper left support member are connected to form an obtuse angle, and wherein the upper end of the substantially vertical rear right support member and the rear end of the upper right support member are connected to form an obtuse angle;

wherein the lower end of the substantially vertical front left support member and the front end of the lower left support member are connected to form a substantially right angle, wherein the lower end of the substantially vertical front right support member and the front end of the lower right support member are connected to form a substantially right angle, wherein the lower end of the substantially vertical rear left support member and the rear end of the lower left support member are connected to form a substantially right angle, and wherein the lower end of the substantially vertical rear right support member and the rear end of the lower right support member are connected to form a substantially right angle; and wherein the back and headrest support member is rockably displaceable between an upright position and a reclined position via a first pair of spaced apart rubber grommets associated with a left side of the floor-engaging frame sub-assembly and a second pair of spaced apart rubber grommets associated with a right side of the floor-engaging frame sub-assembly.

6. The modular cinema lounge chair according to claim 5, wherein the frame sub-assembly comprises an electric motor.

7. The modular cinema lounge chair according to claim 6, wherein the electric motor is secured to a lower middle support member and a foot rest sub-assembly.

8. The modular cinema lounge chair according to claim 5, further comprising a lower rear support member having an inner surface, a lower front support member having an inner surface, and a lower middle support member, wherein the lower middle support member is positioned orthogonal to the lower rear support member and the lower front support member, and is secured to the inner surface of the lower rear support member and the inner surface of the lower front support member, and an electric motor mounted to the lower middle support member, wherein the electric motor drives a linearly displacement rod which is secured to a leg rest sub-assembly, and, in turn, controllably and lockably displaces a leg and foot rest between retracted and extended positions.

* * * * *